US009502845B2

(12) United States Patent
Gross et al.

(10) Patent No.: US 9,502,845 B2
(45) Date of Patent: Nov. 22, 2016

(54) METHOD AND APPARATUS FOR MOUNTING A CABLE CONNECTOR ONTO A PANEL

(71) Applicant: FCI Americas Technology LLC, Carson City, NV (US)

(72) Inventors: Charles M. Gross, York, PA (US); Max Richard Page, Middletown, PA (US)

(73) Assignee: FCI Americas Technology LLC, Carson City, NV (US)

( * ) Notice: Subject to any disclaimer, the term of this patent is extended or adjusted under 35 U.S.C. 154(b) by 0 days.

(21) Appl. No.: 14/576,266

(22) Filed: Dec. 19, 2014

(65) Prior Publication Data

US 2015/0104980 A1 Apr. 16, 2015

Related U.S. Application Data

(62) Division of application No. 13/411,847, filed on Mar. 5, 2012, now Pat. No. 8,935,849.

(60) Provisional application No. 61/451,279, filed on Mar. 10, 2011, provisional application No. 61/451,693, filed on Mar. 11, 2011.

(51) Int. Cl.

| | |
|---|---|
| ***H01R 13/625*** | (2006.01) |
| ***H01R 25/00*** | (2006.01) |
| ***H01R 13/58*** | (2006.01) |
| *H01R 13/518* | (2006.01) |

(52) U.S. Cl.

CPC ..... *H01R 25/006* (2013.01); *H01R 13/5837* (2013.01); *H01R 13/518* (2013.01); *Y10T 29/49147* (2015.01); *Y10T 29/49151* (2015.01); *Y10T 29/49153* (2015.01); *Y10T 29/49174* (2015.01)

(58) Field of Classification Search

CPC . H01R 13/518; H01R 13/659; H01R 13/629
USPC ..... 439/540.1, 954, 345, 370
See application file for complete search history.

(56) References Cited

U.S. PATENT DOCUMENTS

| | | | |
|---|---|---|---|
| 4,405,193 | A | 9/1983 | Weidler |
| 4,519,663 | A | 5/1985 | De Luca |
| 4,606,596 | A | 8/1986 | Whiting et al. |
| D291,532 | S | 8/1987 | Hill |
| D307,541 | S | 5/1990 | Tres |
| 5,222,898 | A | 6/1993 | Fedder et al. |
| D353,578 | S | 12/1994 | Johnson et al. |

(Continued)

OTHER PUBLICATIONS

U.S. Appl. No. 61/368,033, filed Jul. 27, 2010, Zerebilov.

(Continued)

*Primary Examiner* — Tho D Ta
*Assistant Examiner* — Thang Nguyen
(74) *Attorney, Agent, or Firm* — Wolf, Greenfield & Sacks, P.C.

(57) ABSTRACT

A method is provided for mounting a plurality of cable connectors onto a panel that defines a plurality of target mounting locations. At least two of the plurality of cable connectors defines at least a pair of cable retaining apertures. The pairs of cable retaining apertures of a first one of the two cable connectors are spaced apart in a first direction, and the pair of cable retaining apertures of a second one of the two cable connectors are spaced apart in a second direction that is different than the first direction.

24 Claims, 12 Drawing Sheets

(56) References Cited

U.S. PATENT DOCUMENTS

| | | | | |
|---|---|---|---|---|
| 5,453,026 | A | 9/1995 | Ikegami | |
| 5,547,394 | A * | 8/1996 | Comstock | H01R 13/743 439/557 |
| 5,564,941 | A * | 10/1996 | Norden | H01R 4/2433 439/395 |
| 5,645,449 | A | 7/1997 | Sabo | |
| 5,895,292 | A | 4/1999 | Affeltranger | |
| 6,146,192 | A | 11/2000 | Cabalka et al. | |
| 6,231,380 | B1 | 5/2001 | Cabalka et al. | |
| 6,364,534 | B1 | 4/2002 | Lampert | |
| 6,457,999 | B1 * | 10/2002 | Baker | H01R 13/514 439/173 |
| 6,607,303 | B2 | 8/2003 | Ngo et al. | |
| 7,018,241 | B2 * | 3/2006 | Caveney | H01R 13/514 439/418 |
| 7,029,182 | B2 | 4/2006 | Ngo | |
| 7,128,470 | B2 * | 10/2006 | Scherer | G02B 6/3869 385/59 |
| 7,179,117 | B2 * | 2/2007 | Wu | H01R 13/59 439/460 |
| 7,186,133 | B1 | 3/2007 | Szczesny | |
| 7,357,667 | B2 | 4/2008 | Clark et al. | |
| 7,529,458 | B2 | 5/2009 | Spisany et al. | |
| 7,544,090 | B2 | 6/2009 | Follingstad | |
| D618,181 | S | 6/2010 | Gross et al. | |
| D626,089 | S | 10/2010 | Luo et al. | |
| 7,811,122 | B2 | 10/2010 | Clark et al. | |
| 7,934,948 | B2 | 5/2011 | Follingstad | |
| RE44,141 | E | 4/2013 | Cabalka et al. | |
| 8,573,997 | B2 * | 11/2013 | Neer | H01R 9/038 439/345 |
| 8,585,426 | B2 | 11/2013 | Zerebilov | |
| 2002/0182932 | A1 * | 12/2002 | Petrie | H01R 13/514 439/540.1 |
| 2003/0092314 | A1 * | 5/2003 | Whiteside | H01R 9/2491 439/540.1 |
| 2003/0124904 | A1 * | 7/2003 | Lin | H01R 13/5841 439/502 |
| 2004/0048513 | A1 * | 3/2004 | Egbert | H01R 9/0515 439/578 |
| 2004/0248464 | A1 * | 12/2004 | Xue | H01R 12/716 439/541.5 |
| 2005/0135752 | A1 | 6/2005 | Kiani et al. | |
| 2006/0025014 | A1 | 2/2006 | Spink, Jr. | |
| 2011/0212643 | A1 * | 9/2011 | Reed | H01R 9/038 439/345 |
| 2011/0237122 | A1 * | 9/2011 | Schwarz | H01R 13/514 439/578 |
| 2012/0058665 | A1 * | 3/2012 | Zerebilov | H01R 13/6335 439/370 |
| 2012/0227262 | A1 | 9/2012 | Gross et al. | |

OTHER PUBLICATIONS

"Protect Your Home from Termites with the Sentricon System", www.sentricon.com, 2011, Accessed Jul. 7, 2011, 1 page.

* cited by examiner

METHOD AND APPARATUS FOR MOUNTING A CABLE CONNECTOR ONTO A PANEL

CROSS-REFERENCE TO RELATED APPLICATIONS

This is a divisional of U.S. patent application Ser. No. 13/411,847 filed Mar. 5, 2012, which claims the benefit of U.S. Patent Application Ser. No. 61/451,279 filed Mar. 10, 2011 and U.S. Patent Application Ser. No. 61/451,693 filed Mar. 11, 2011, the disclosure of each of which is hereby incorporated by reference as if set forth in its entirety herein. This application is related by subject matter to U.S. patent application Ser. No. 29/388,826 filed on Apr. 1, 2011.

BACKGROUND

Cable connectors typically include a connector housing that carries a plurality of electrical contacts configured to connect to a cable at one end, and configured to mate with a complementary electrical device at a mating end, thereby placing the complementary electrical device in communication with the cable. The cable can be, for instance, an optical (e.g., fiber optic) cable configured to be placed in communication with an optical transceiver, or a power cable configured to deliver electrical power to a complementary electrical component. Thus, the complementary electrical device can be configured as an electrical connector or any suitable alternative component such as an optical transceiver.

Conventional cable connectors are available in several configurations. For instance, the cable connector can be configured to electrically connect to a pair of cables that are oriented in a horizontal side-by-side spatial relationship, a vertical side-by-side spatial relationship, or a diagonal spatial relationship.

SUMMARY

In accordance with one embodiment, a method is provided for mounting a plurality of cable connectors onto a panel that defines a plurality of target mounting locations, at least two of the plurality of cable connectors defining at least a pair of cable retaining apertures that are spaced apart in different directions. The method can include the step of identifying a desired cable route path associated with a select target mounting location of the plurality of target mounting locations. The method can further include the step of identifying a select cable connector among a plurality of cable connectors, the select cable connector defining at least a pair of cable retaining apertures that are spaced apart along a direction that has a directional component angularly offset with respect to the desired cable route path. The method can further include the step of mounting the select cable connector onto the panel at the select target mounting location.

BRIEF DESCRIPTION OF THE DRAWINGS

The foregoing summary, as well as the following detailed description of an example embodiment of the application, will be better understood when read in conjunction with the appended drawings, in which there is shown in the drawings an example embodiment for the purposes of illustration. It should be understood, however, that the application is not limited to the precise arrangements and instrumentalities shown. In the drawings.

DETAILED DESCRIPTION

Figure 1:
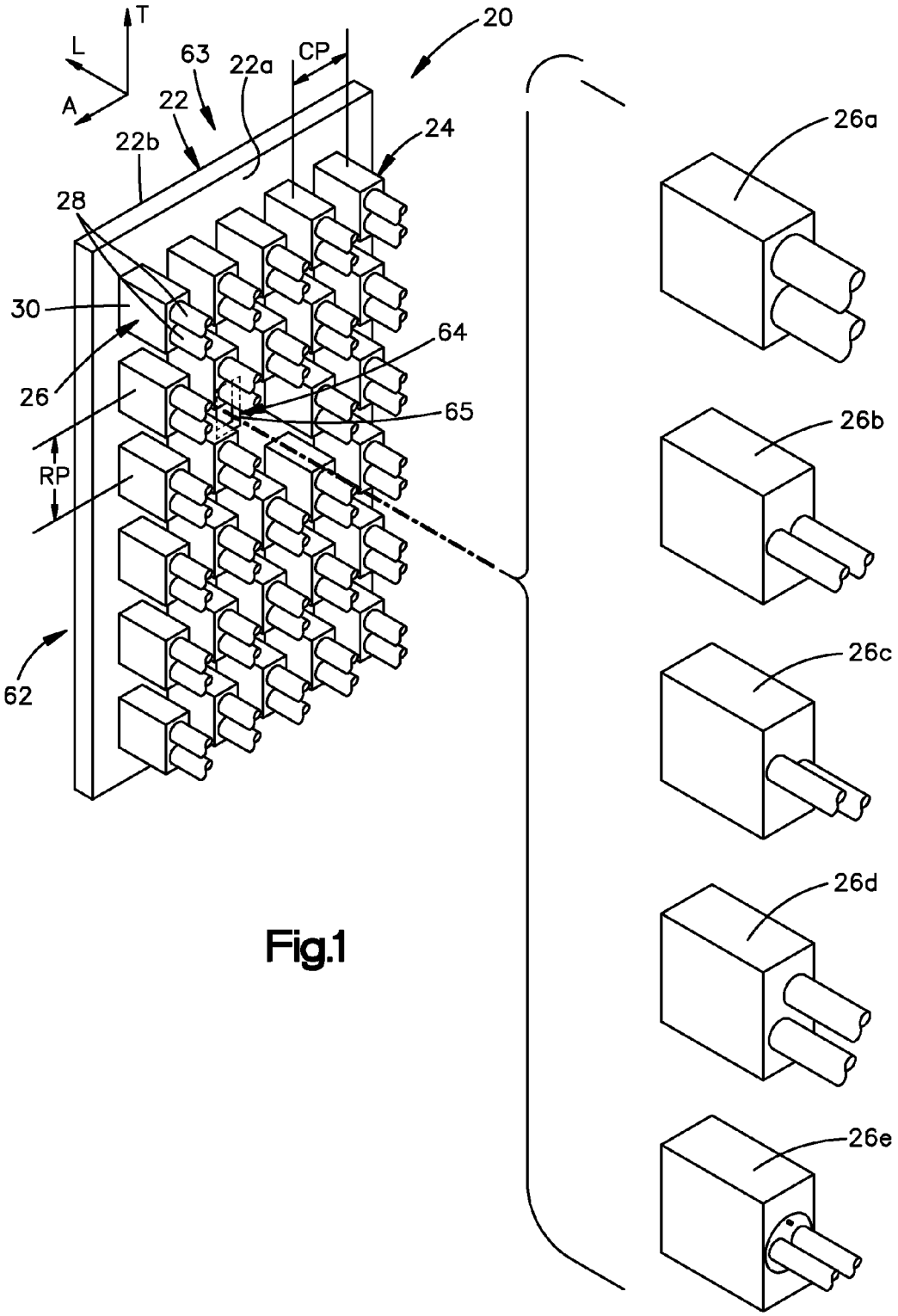
FIG. 1 is a schematic perspective view of a cable connector system including a panel and a plurality of cable connector assemblies mounted onto the panel, each cable connector assembly including a cable connector mounted to a pair of cables, showing a plurality of select cable connector assemblies exploded out from a target mounting location on the panel.

Referring to FIG. 1, a cable connector system 20 includes a panel 22 and a plurality of cable connector assemblies 24 configured to be mounted onto the panel 22 at respective target mounting locations 64 defined by the panel 22. Each cable connector assembly 24 includes at least one electrical connector, such as a plurality of electrical connectors that can be configured as cable connectors 26, and at least a pair of cables 28 that configured to be electrically connected to each of the cable connectors 26 a mounting interface 46 of the cable connectors 26. As will be appreciated from the description below, the mounting interface 46 includes a pair of cable retaining apertures 48*a-b* that are each configured to support, for instance retain, a respective one of the pair of cables 28 spaced from each other along a different direction with respect the cable retaining apertures 48*a-b* of at least a second one of the cable connectors 26 when the first and second cable connectors 26 are mounted to the panel 22, such that the respective cables 28 can be routed in a corresponding desired direction.

Thus, the cables 28 of at least a first one of the cable connector assemblies 24 can be spaced along a different direction with respect to a second one of the cable connector assemblies 24 when the respective cable connectors 26 are mounted to the cables 28 and mounted onto the panel 22. The cables 28 can be configured as optical (e.g., fiber optic) cables configured to carry and transmit data, or can alternatively be configured as power cables configured to carry and transmit power, or any other type of cable. Thus, the cables 28 can be configured as high-speed copper or fiber-optic cables, or any suitable alternatively constructed cables as desired. While the panel 22 is illustrated as a free-standing wall, it should be appreciated that the panel 22 can at least partially define a full or partial enclosure as desired.

Each cable connector 26 includes a connector housing 30 and at least one electrical contact supported by the connector housing and configured to be placed in electrical communication with, or mounted to, the cables 28 and a complementary electrical component. The cables 28 can be configured as optical cables, and the complementary electrical component can be in the form of an optical transceiver. The complementary electrical component can further be in the form of a complementary cable connector that is configured to be mounted to an optical transceiver and configured to be mated with the cable connector 26 so as to place the cables 28 in communication with the optical transceiver. The cables 28 can alternatively be configured as power cables, and the complementary electrical component can be in the form of an electrical connector, such as a complementary cable connector that is configured to be mounted to an electrical component and mated with the cable connector 26 so as to place the cables 28 in communication with the electrical component, such that the electrical component receives power from the cables 28.

In accordance with the illustrated embodiment, the panel 22 defines first and second opposed panel faces 22*a* and 22*b* that are spaced apart along a longitudinal direction L. Each of the first and second panel faces 22*a* and 22*b* can extend along a lateral direction A that is substantially perpendicular to the longitudinal direction L, and a transverse direction T that is substantially perpendicular to both the longitudinal direction L and the lateral direction A. In accordance with the illustrated embodiment, the transverse direction T is oriented vertically, and the longitudinal and lateral directions L and A are oriented horizontally, though it should be appreciated that the orientation of the panel 22 may vary during use. Furthermore, the cable connectors 26 are described herein with reference to the longitudinal, lateral, and transverse direction L, A, and T oriented as mounted on the panel 22.

Figure 2A:
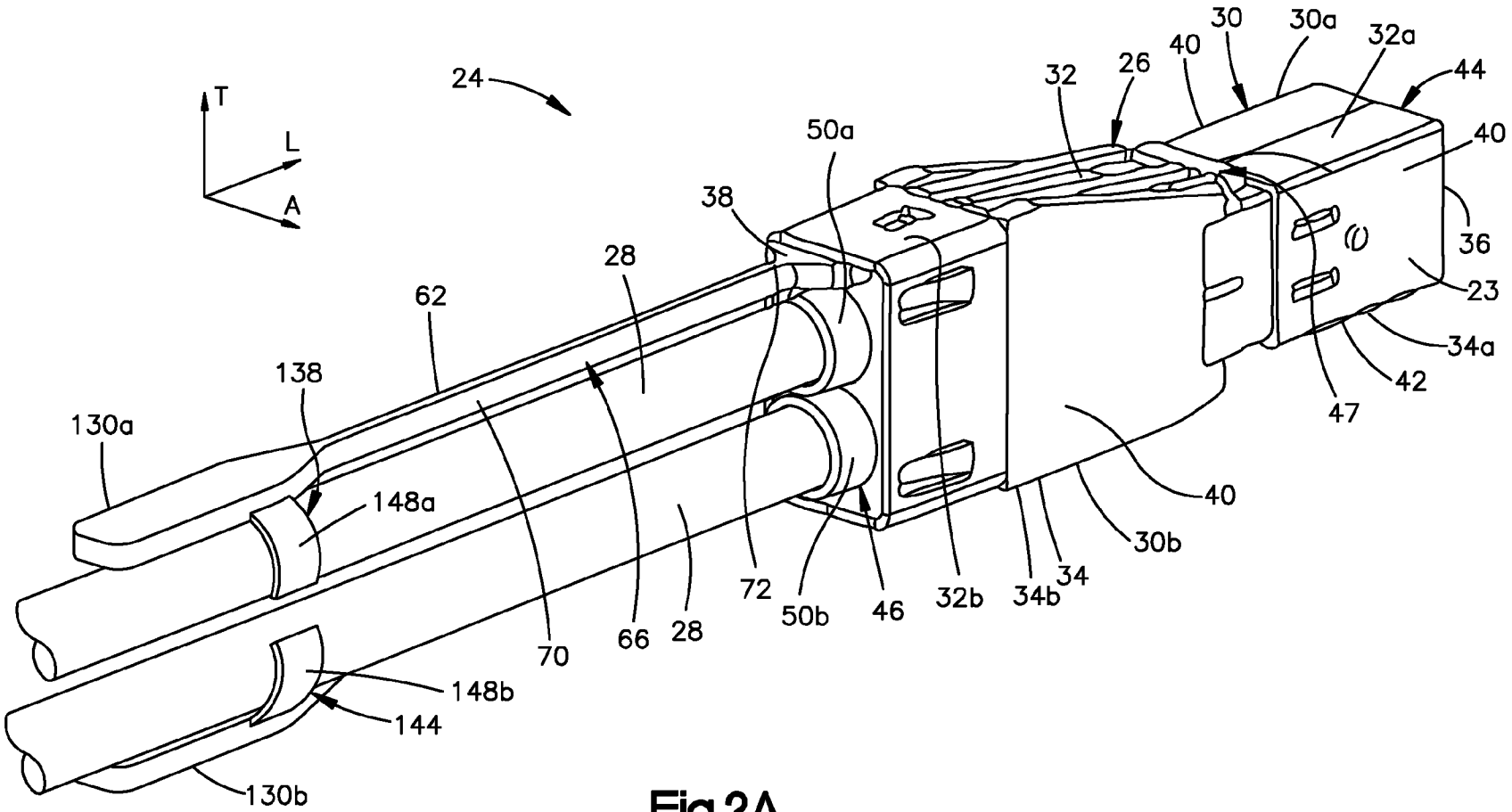
FIG. 2A is a perspective view of a cable connector assembly connector of the type illustrated in FIG. 1, including a cable connector mounted to a pair of cables, showing the cable connector including a mounting interface that supports the cables in a vertical side-by-side spatial relationship.
Figure 2B:
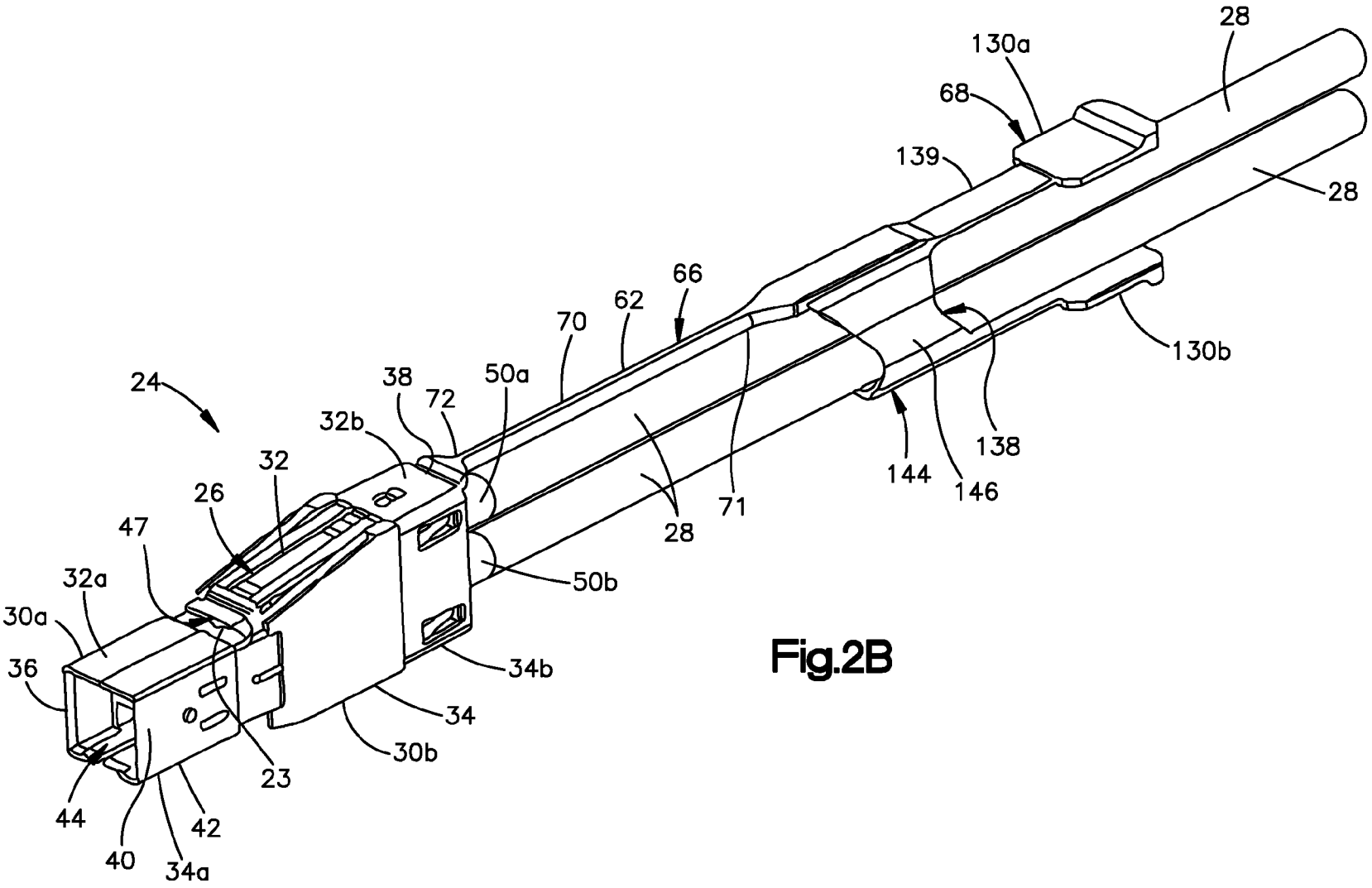
FIG. 2B is another perspective view of the cable connector assembly illustrated in FIG. 2A.

In one embodiment, the cable connectors 26 can be constructed generally as described in U.S. patent application Ser. No. 13/189,380, filed Jul. 22, 2011, the disclosure of which is hereby incorporated by reference as if set forth in its entirety herein. For instance, referring to FIGS. 2A-C, each of the cable connectors 26 can include a connector housing 30 that defines a top end 32, an opposed bottom end 34 that is spaced from the top end 32 along the transverse direction T, and thus along a direction that is substantially parallel to a plane defined by at least the first panel face 22*a*. The connector housing 30 further defines a front end 36 and an opposed rear end 38 that is spaced from the front end along the longitudinal direction L, and thus along a direction that is substantially perpendicular to the plane defined by at least the first panel face 22*a*. The connector housing further defines a pair of opposed sides 40 spaced from each other along the lateral direction A, and thus along a direction that is substantially parallel to the plan defined by at least one or both of the panel faces 22*a-b*. The connector housing 30 may be made from any suitable dielectric material, such as a plastic, and can be injection molded or otherwise fabricated using any desired process. For instance, the connector housing 30 can be a die-cast metal housing.

As discussed above, the cable connectors 26, and thus the cable assemblies, 24, can be mounted onto the panel 24, for instance onto the first panel face 22*a* of the panel 24. For instance, the cable connectors 26 can be mated with complementary electrical connectors that are mounted onto the panel 24, for instance onto the opposed second panel face 22*b* of the panel 24, so as to mount the cable connectors 26 to the panel. In accordance with one embodiment, the complementary electrical connectors are inserted at least into or through respective select ones of the mounting apertures 65 of the panel 24. The cable connectors 26 can then be mated with the complementary electrical connectors so as to thereby mount the cable connectors 26 onto the panel 24. Thus, the cable connectors 26 can be indirectly mounted to the panel 24, for instance via an intervening complementary electrical connector, such that the cable connectors 26 are supported by the panel 24, for instance indirectly via the intervening complementary electrical connector. In accordance with another embodiment, the cable connectors 26 can be mounted directly onto the panel, such that the cable connectors are directly supported by the panel 24, and the complementary electrical connector can be mated with the cable connectors 26 that are mounted onto the panel 24. Furthermore, it should be appreciated that whether the cable connectors 26 are mounted directly or indirectly onto the panel 24, the cable connectors 26 can extend at least partially into or through the mounting apertures 65.

The connector housing 30 can include a first or front housing portion 30*a* that defines a leading end of the connector housing 30 with respect to insertion into a mounting aperture 65 of the panel 22 (see FIG. 1), and a second or rear housing portion 30*b* that is disposed behind the front housing portion 30*a* along the longitudinal direction L and defines a trailing end of the connector housing 30. The front housing portion 30*a* can include a shroud 23 that surrounds at least one electrical contact such as a plurality of electrical conductors or contacts 37 (FIG. 2D). The shroud 23 defines at least one surface, which can include at least one or all of a top surface 32*a*, a bottom surface 34*b*, and opposed sides 40. Similarly, the rear housing portion 30*b* can define a corresponding at least one surface, which can include at least one or all of a top surface 32*b*, a bottom surface 34*b*, and opposed sides 40. The at least one surface of the shroud 23 can be inwardly recessed with respect to the at least one surface of the rear housing portion 30*b*. Thus, the top surface 32*a* can be disposed inward of, or below, the top surface 32*b* along the transverse direction T, the bottom surface 34*a* can be disposed inward of, or above, the bottom surface 34*b* along the transverse direction T, and one or both of the sides 40 can be disposed inward with respect to one or both of the sides 40 along the lateral direction A. Alternatively, at least one up to all of the respective surfaces of the shroud 23 can be substantially inline or outwardly recessed with respect to the corresponding respective surfaces of the rear housing portion 30*b*. The cable connector 26 can define a stop surface that is configured to abut the panel 22 once the cable connector 26 has been fully seated into the mounting aperture 65. The stop surface can be defined by the longitudinally front end of the rear housing portion 30*b*, or can be defined by a projection that extends from the connector housing 30, for instance from front housing portion 30*a* or the rear housing portion 30*b*, or any other suitable location of the connector housing 30.

The connector housing 30 defines a mating interface 44 that is disposed at the front end of the front housing portion 30*a* and is configured to mate with the complementary electrical component along a forward mating direction that extends along the longitudinal direction L. The connector housing 30 further defines a mounting interface 46 that is carried by the rear housing portion 30*b* of the connector housing 30 and is configured to support the cables 28. In particular, the shroud 23 is configured to interface with a complementary connector housing of the complementary electrical component so as to place the electrical contacts 37 in electrical communication with complementary electrical contacts of the complementary electrical component. In accordance with the illustrated embodiment, the shroud 23 is configured to be received in the complementary housing of the complementary electrical component.

In accordance with the illustrated embodiment, the cable connector 26 is a vertical cable connector whereby the mating interface 44 is oriented substantially parallel to the mating interface 44. Alternatively, the cable connector 26 can be configured as a right-angle cable connector whereby the mating interface 44 is oriented substantially perpendicular to the mounting interface 46.

Figure 2C:
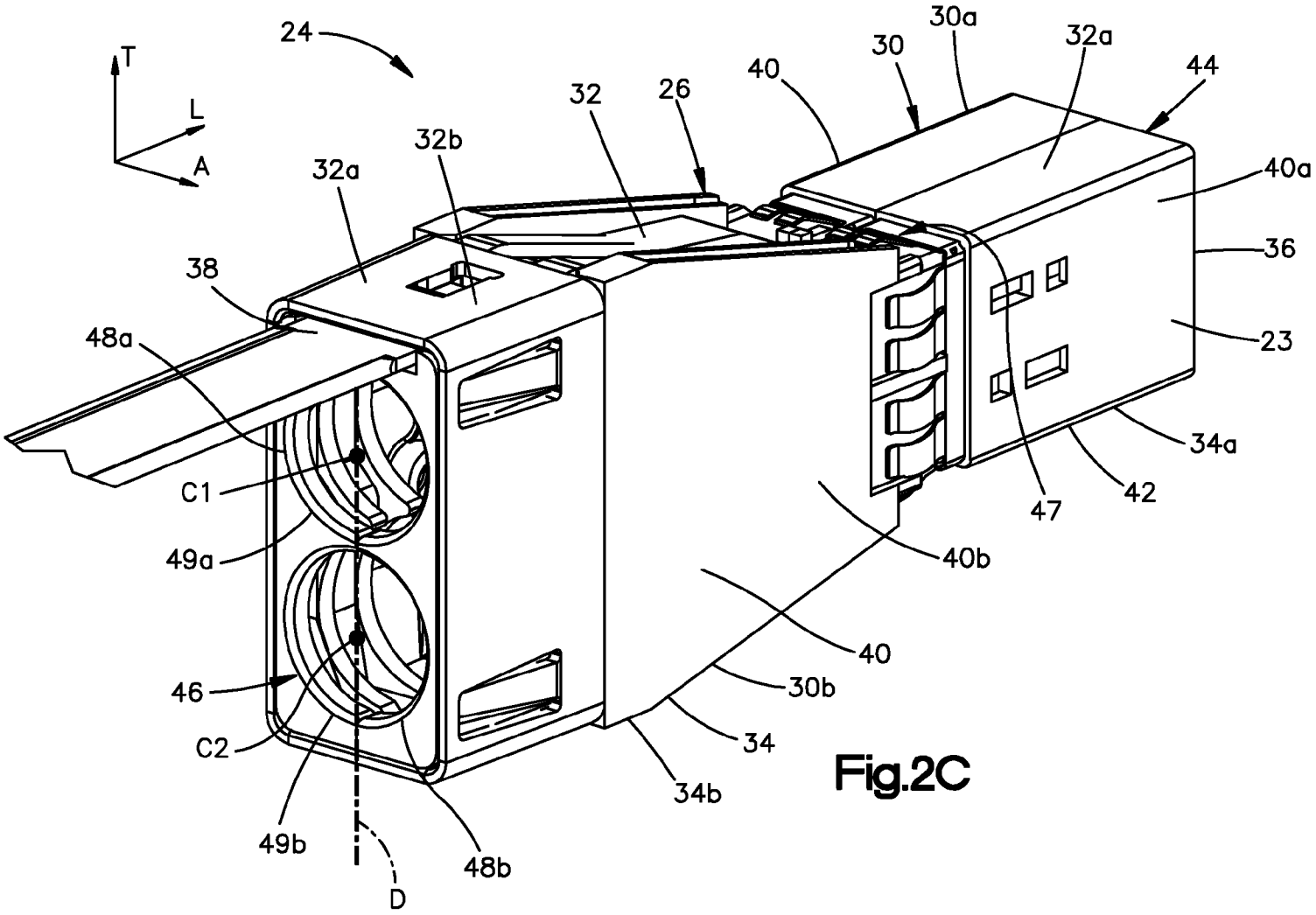
FIG. 2C is a perspective view of the cable connector illustrated in FIG. 2B, showing ferrules removed.
Figure 2D:
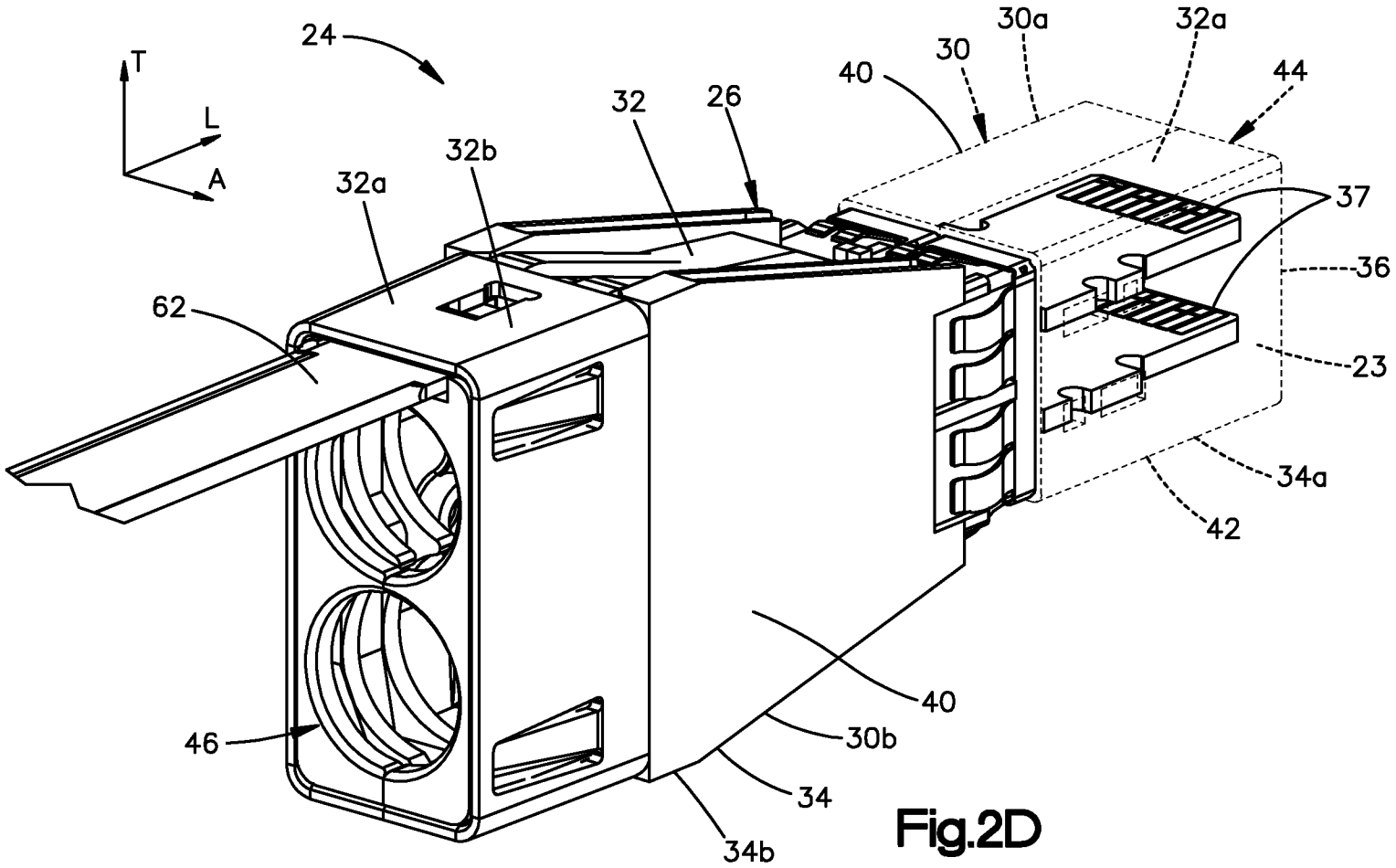
FIG. 2D is a perspective view of the cable connector illustrated in FIG. 2C, with the enclosure of the mating portion of the connector in phantom view.

Referring to FIG. 2C, the mounting interface 46 can respective first and second guides 49*a-b* that are configured to support the respective cables 28 such that the cables 28 are spaced apart along a predetermined direction D. The first and second guides 49*a-b* can be configured as first and second cable retaining apertures 48*a-b* that extend longitudinally through the connector housing 30, such as at the rear end 38, and are configured to retain first and second cables 28, respectively. The cable retaining apertures 48*a-b* are configured to receive at least a portion of respective ones of the cables 28 that are placed in electrical communication with the electrical contacts 37, which can in turn be carried by a substrate in the form of a printed circuit board that is supported by the connector housing 30 (see FIG. 2D). Thus, the electrical contacts 37 are likewise supported by the connector housing 30. The cable retaining apertures 48*a-b* can be at least partially defined by the connector housing 30, for instance by the rear end 38 that can be carried by the rear housing portion 30*b*. The first and second cable retaining apertures 48*a-b* can further define respective centroids C1 and C2 that are coincident with the central axes of the cable retaining apertures 48*a-b* at the mounting interface 46, respectively, that are spaced from each other along the predetermined direction D.

The first and second guides 49*a-b* can further include first and second ferrules 50*a-b*, respectively, that extend out, for instance longitudinally rearward, from the rear end 38 of the connector housing 30, for instance at the rear housing portion 30*b*. The first and second cable retaining apertures 48*a-b* can further extend through ferrules 50*a-b* such that the ferrules 50*a-b* surround and support respective ones of the cables 28. Thus, it should be appreciated that the first and second cable retaining apertures 48*a-b* can extend through the connector housing 30 and can further extend through the first and second ferrules 50*a-b*, respectively.

With continuing reference to FIGS. 2A-D, the cable connector 26 includes a latch assembly 47 that is configured to releasably lock the connector housing 30 to the complementary housing of the complementary electrical component to which the cable connector 26 is mated. The latch assembly 47 can include an actuator 62 that can be configured as a pull tab 66 that can be grasped and pulled longitudinally rearwardly so as to actuate the latch assembly from a locked position to an unlocked position whereby the latch assembly allows the connector housing 30 to be detached from the housing of the complementary electrical component. The pull tab 66 can include an actuator portion illustrated as a grip portion 68 that can be textured as desired, and at least one arm 70 that extends forward from the grip portion 68 and can define any suitably shaped cross-section as desired.

The arm 70 can longitudinally along one of the cables 28, and can alternatively extend between the cables 28. The grip portion 68 of the pull tab 66 includes at least one grip tab, such as a first grip tab 130*a* and a second grip tab 130*b* that is spaced from the first grip tab 130*a*, such that the cables 28 are disposed between the grip tabs 130*a* and 130*b*. The grip portion 68 can further include a flexible junction 138 that joins the grip tabs 130*a* and 130*b* to each other, and can also join at least one or both of the grip tabs 130*a-b* to the arms 70. The junction 138 can be provided as a discontinuous connection band 144 that includes a middle portion 146 connected between the grip tabs 130*a* and 130*b*. Thus, the junction 138 can connect the first grip tab 130*a* to the second grip tab 130*b*, such that the second grip tab 130*b*, along with the first grip tab 130*a*, is supported by the at least one arm 70.

The connection band 144 further includes transversely opposed first and second cable retention cable grips 148*a* and 148*b* that extend transversely inward from the opposed transverse ends of the connection band 144 and slidably retain at least one cable 28, such as the first and second cables 28, so that the first and second cables 28 are slidable in the connection band 144, and thus in the junction 138, as the cables 28 are routed along their respective cable route paths.

Referring again to FIG. 1, and as described above, the panel 22 defines a plurality of target mounting locations 64 that each includes a corresponding mounting aperture 65 defined by the panel 22. Each of the mounting apertures 65 can extend through the panel, for instance along the longitudinal direction L, from the first panel face 22*a* to the second panel face 22*b*. Each of the mounting apertures 65 is configured to receive a respective one of the cable connectors 26. For instance, the mounting apertures 65 can be sized having a cross-sectional dimension greater than that of a first region of a respective one of the cable connectors 26 of the cable connector system 20, whereby the first region can be defined for instance by the leading end of the respective connector housing 30, such as the shroud 23. The cross-sectional dimension of the mounting apertures 65 can be less than that of a second region of the respective one of the cable connectors 26 of the cable connector system 20. The second region can be defined by a stop member of the type described above, and can be defined by the rear housing portion 30*b* that can include at least one surface that is outwardly spaced from a corresponding surface of the first region. Accordingly, the leading end of the connector housing 30 can be inserted into a respective one of the mounting apertures 65 along the longitudinal direction from the first panel face 22*a* toward the second panel face 22*b* until the stop surface abuts the first panel face 22*a* when the cable connector 26 is fully seated in the mounting aperture 65. The mating interface 44 can then attach to the mating end of the housing of the complementary electrical component, so as to mount the complementary electrical component to the second panel face 22*b*.

The mounting apertures 65 can be arranged in a plurality of rows 62 that extend along the lateral direction A and are spaced from each other along the transverse direction T. In accordance with the illustrated embodiment, the rows 62 are parallel to each other, though it should be appreciated that each of the rows 62 can extend along any direction as desired. The mounting apertures 65 can further be arranged in a plurality of columns 63 that extend along the transverse direction T and are spaced from each other along the lateral direction A. In accordance with the illustrated embodiment, the columns 63 are parallel to each other, though it should be appreciated that each of the columns 63 can extend along any direction as desired.

It is recognized that the panel 22 can consume valuable real estate, and it is generally desirable to mount the cable connectors 26 onto the panel 22 at respective target mounting locations 64 that are within close proximity of each other. For instance, each of the rows 62 can be spaced from each other so as to define a row pitch RP of about 40 mm to 80 mm along the transverse direction T, and each of the columns can be spaced from each other so as to define a column pitch CP pitch of about 25 mm to 60 mm along the lateral direction A. It is further recognized that when cable connectors 26 of a conventional cable connector system are mounted onto a panel at their respective target mounting locations, the cables can mechanically interfere with each other, thereby causing the cables to be bent to a radius beyond which is desirable in order to route the cables along their desired cable route path which, in extreme circumstances, can place high stresses on the cables.

Accordingly, with continuing reference to FIG. 1, the cable connectors 26 can include at least a first and a second cable connector having differently configured respective mounting interfaces 46 that space the corresponding first and second cables 28 along directions that have different transverse and lateral directional components. The at least a first and second cable connector can include at least a first and second cable connector that can be configured as different cable connectors selected from a first at least one cable connector 26*a* such as a first plurality of cable connectors 26*a*, a second at least one cable connector 26*b* such as a second plurality of cable connectors 26*b*, a third at least one cable connector 26*c* such as a third plurality of cable connectors 26*c*, a fourth at least one cable connector 26*d* such as a fourth plurality of cable connectors 26*d*, and a fifth at least one cable connector 26*e* such as a fifth plurality of cable connectors 26*e*. Each of the different cable connectors 26*a-e* define mounting interfaces that retain the respective cables 28 in different predetermined spatial relationships such that the respective cables 28 of each cable connector 26 are spaced apart in corresponding different directions D1-D5 that are angularly offset from each other, where the direction D5 can be an adjustable direction. Accordingly, at least one or more up to the all of the cable connectors 26*a-e* can be mounted onto the panel 22 at the respective target mounting locations 64 so that the respective cables 28 that extend out from the cable connectors 26 spaced at different directions from each other. The ability to space the cables 28 of each cable connector 26 at different directions allow the cables 28 to be routed according to the desired system design while reducing the bend radius of at least one of the cables 28 of the cable connector system 20 with respect to those of conventional cable connector systems.

Referring now to FIGS. 1 and 3A-7B in general, each cable connector 26*a*-26*e* includes a connector housing 30 of the type described above with respect to FIGS. 2A-D, but having mounting interfaces 46 that include cable retention apertures 48*a-b* that are disposed in different spatial relationships so as to correspondingly support the respective cables 28 in the different spatial relationships. When the cable connectors 26*a-e* are mounted onto the panel 22, the front and rear ends 36 and 38, respectively, are spaced apart along the longitudinal direction L, the opposed sides 48 are spaced apart along the lateral direction A, and the top and bottom ends 32 and 34 are spaced apart along the transverse direction T. The cables 28 are configured to extend longitudinally out the rear end 38 of the connector housings 30, such that the rear end 38 can define the mounting interface 46.

The cable connectors 26*a*-26*d* can further define at least first and second guides 49*a-b* that are configured to support the cables 28 in a predetermined location such that the cables 28 are spaced apart along a desired direction. The guides 49*a-b* can be configured as cable retaining apertures 48*a-b* that extend through the rear end 38 of the connector housing 30, or as any other structure configured to support the cables 28 in the desired position, as described above. The cable retaining apertures 48*a-b* are configured to retain the respective cables 28 so as to place the cables in electrical communication with the electrical contacts of the cable connector 26. While each cable connector 26 defines a pair of cable retaining apertures 48*a-b*, it should be appreciated that each cable connector 26 can define any number of cable retaining-apertures as desired. For instance, at least one or more up to all of the cable connectors 26 can define at least a pair of adjacent cable retaining apertures 48*a-b*, while at least one or more of the cable connectors 26 can define at least one cable retaining aperture.

Figure 3A:
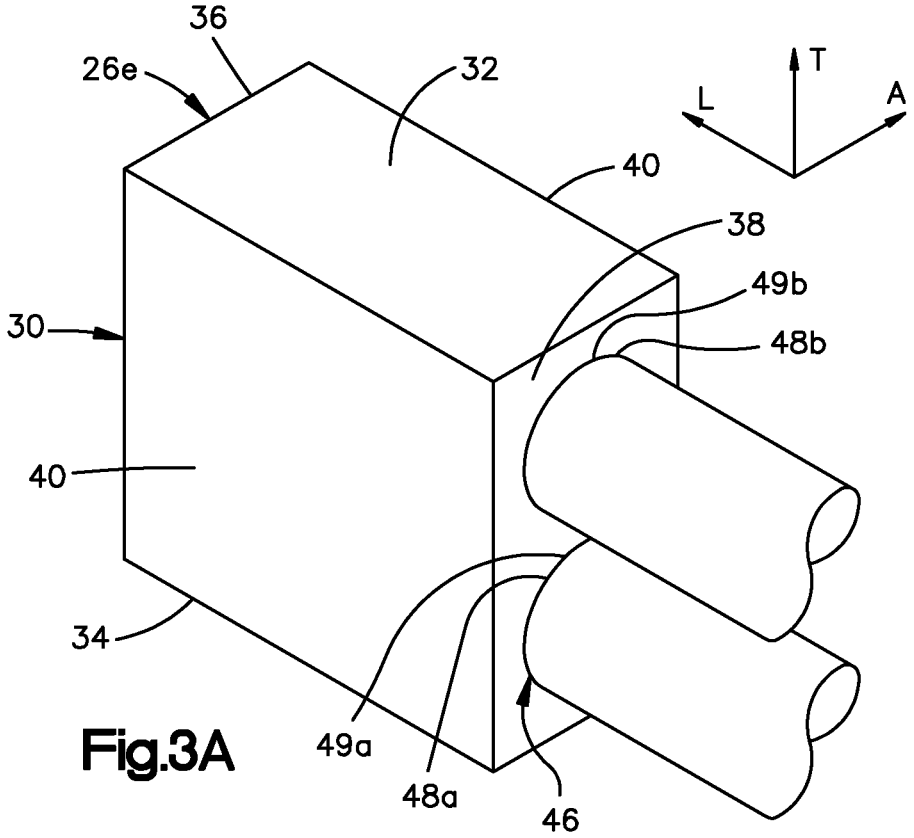
FIG. 3A is a schematic perspective view of the cable connector assembly illustrated in FIGS. 2A-B.
Figure 3B:
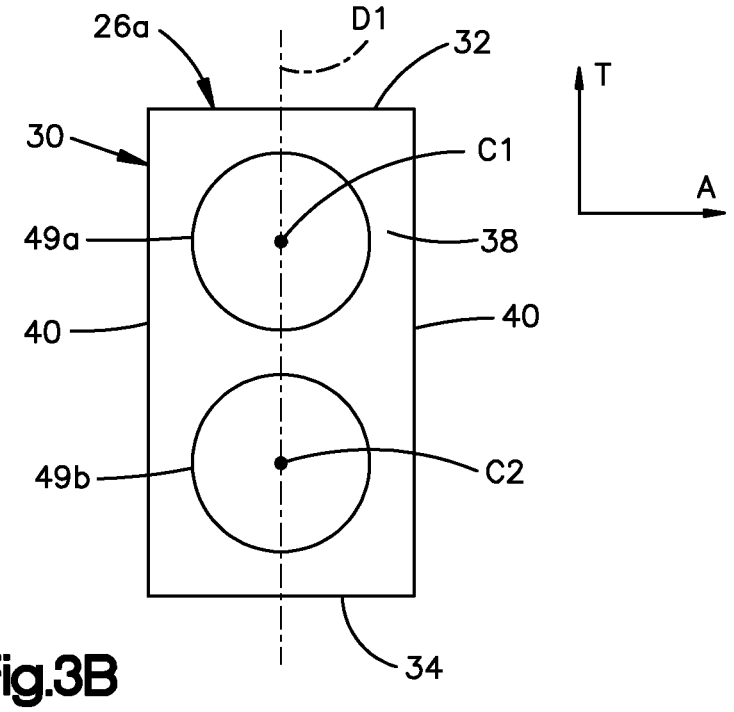
FIG. 3B is a rear elevation view of the cable connector assembly illustrated in FIG. 3A.

Referring now to FIGS. 3A-B, the cable retaining apertures 48*a-b* of the at least one first cable connector 26*a*, for instance the centroids C1 and C2 of the cable retaining apertures 48*a-b*, are spaced apart along a first direction D1 that is defined by a line that passes through the centroids C1 and C2. The first direction D1 is illustrated as extending along the transverse direction T. Accordingly, the centroids C1 and C2 of the cable retaining apertures 48*a-b*, and thus the corresponding first and second cables 28 that are retained in the cable retaining apertures 48*a-b*, are spaced apart vertically when the first cable connector 26*a* is mounted onto the panel 22 in the manner described above. When the first cable connector 26*a* is mounted onto the panel 22, it should be appreciated that the respective cables 28 can be bent and routed substantially along a desired cable route path that is angularly offset with respect to the direction in which the cable retaining apertures 48*a-b* are spaced, such that the cables 28 do not interfere with each other and further do not substantially interfere with cables of other cable connectors of the cable connector system 20. Accordingly, the cable retaining apertures 48*a-b* are spaced apart along a direction that has a directional component angularly offset with respect to the desired cable route path. For instance, the cable retaining apertures 48*a-b* are spaced apart along a direction that is substantially perpendicular with respect to the desired cable route path of the cables 28 that are attached to the at least one first cable connector 26*a*.

Accordingly, in the embodiment illustrated in FIGS. 3A-B, the centroids C1 and C2 of the cable retaining apertures 48*a-b* of the first cable connector 26*a* are spaced along the transverse direction T, and the cable route path of the cables 28 can include a directional component in the lateral direction A that is substantially perpendicular to the transverse direction T. For instance, the cable route path can be substantially lateral, such that the cables 28 can be bent so as to extend laterally as they extend away from the connector housing 30 along the cable route path. It should be appreciated that the route paths of the cables 28 can be offset with respect to a pure lateral direction depending, for instance, on the distance or clearance between the adjacent cables 28 when the cables 28 are disposed in the cable retaining apertures 48*a-b*. In accordance with one embodiment, the cable route paths of the cables 28 of the first cable connector 26 can be substantially parallel to each other along substantially the same direction, or the route paths of the cables 28 can be different, such as substantially opposite to each other. For example, one cable 28 can extend in laterally opposite directions.

Figure 4A:
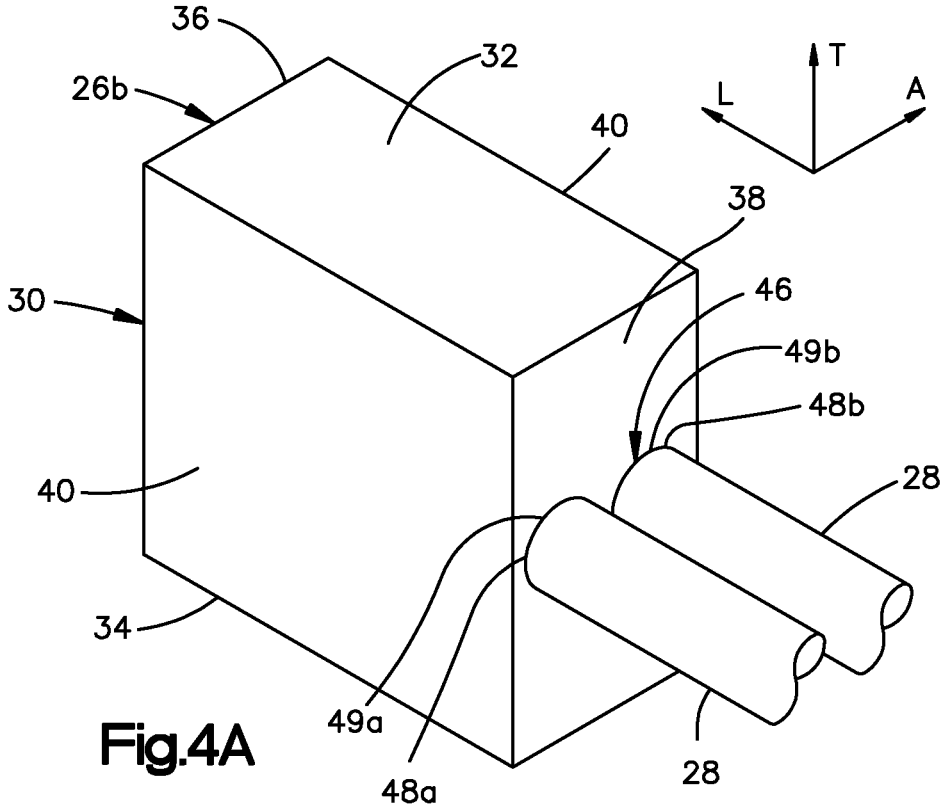
FIG. 4A is a schematic perspective view of another of the cable connector assemblies exploded out in FIG. 1, shown similar to the cable connector assembly illustrated in FIGS. 2A-D, but wherein the mounting interface of the cable connector supports the pair of cables in a horizontal side-by-side spatial relationship.
Figure 4B:
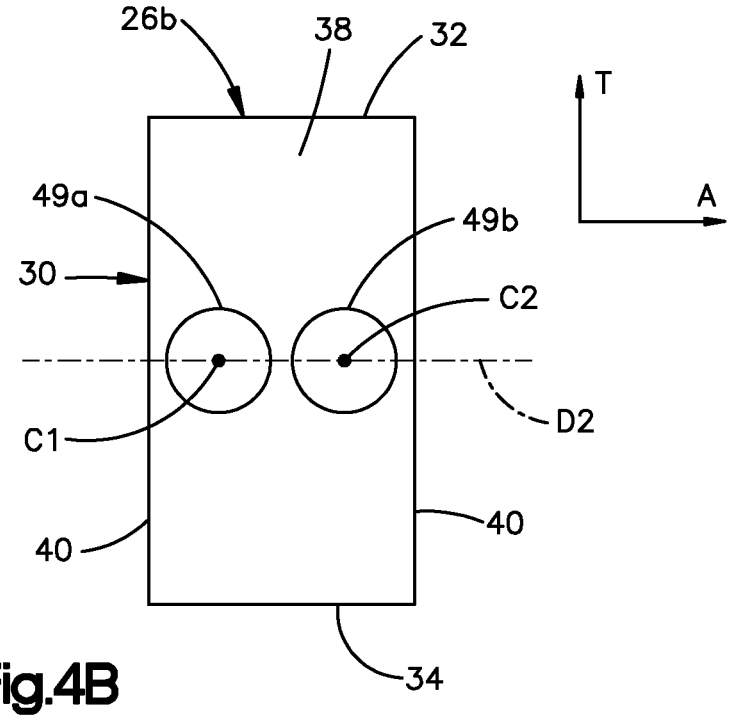
FIG. 4B is a rear elevation view of the cable connector assembly illustrated in FIG. 4A.

Referring now to FIGS. 4A-B, the cable retaining apertures 48*a-b* of the at least one second cable connector 26*b*, for instance the centroids C1 and C2 of the cable retaining apertures 48*a-b*, are spaced apart along a second direction D2 that is defined by a line that passes through the centroids C1 and C2. The second direction D2 is illustrated as extending along the transverse direction T that is angularly offset with respect to the first direction D1. For instance, the second direction D2 is illustrated as the lateral direction A. Accordingly, the centroids C1 and C2 of the cable retaining apertures 48*a-b*, and thus the corresponding first and second cables 28 that are retained in the cable retaining apertures 48*a-b*, are spaced apart horizontally when the second cable connector 26*b* is mounted onto the panel 22 in the manner described above. When the second cable connector 26*b* is mounted onto the panel 22, it should be appreciated that the respective cables 28 can be bent and routed substantially along a desired cable route path that is angularly offset with respect to the direction in which the cable retaining apertures 48*a-b* are spaced, such that the cables 28 do not interfere with each other and further do not substantially interfere with cables of other cable connectors of the cable connector system 20. Accordingly, the cable retaining apertures 48*a-b* are spaced apart along a direction that has a directional component angularly offset with respect to the desired cable route path. For instance, the cable retaining apertures 48*a-b* are spaced apart along a direction that is substantially perpendicular with respect to the desired cable route path of the cables 28 that are attached to the at least one second cable connector 26*b*.

Accordingly, in the embodiment illustrated in FIGS. 4A-B, the centroids C1 and C2 of the cable retaining apertures 48*a-b* of the at least one second cable connector 26*b* are spaced along the lateral direction A, and the cable route path of the cables 28 can include a directional component in the transverse direction T that is substantially perpendicular to the lateral direction A. For instance, the cable route path can be substantially transverse, such that the cables 28 can be bent so as to extend along the transverse direction as they extend away from the connector housing 30 along the cable route path. It should be appreciated that the route paths of the cables 28 can be offset with respect to a pure transverse direction depending, for instance, on the distance or clearance between the adjacent cables 28 when the cables 28 are disposed in the cable retaining apertures 48*a-b*. In accordance with one embodiment, the cable route paths of the cables 28 of the first cable connector 26 can be substantially parallel to each other along substantially the same direction, or the route paths of the cables 28 can be different, such as substantially opposite to each other. For example, one cable 28 can extend in opposite transverse directions.

Figure 5A:
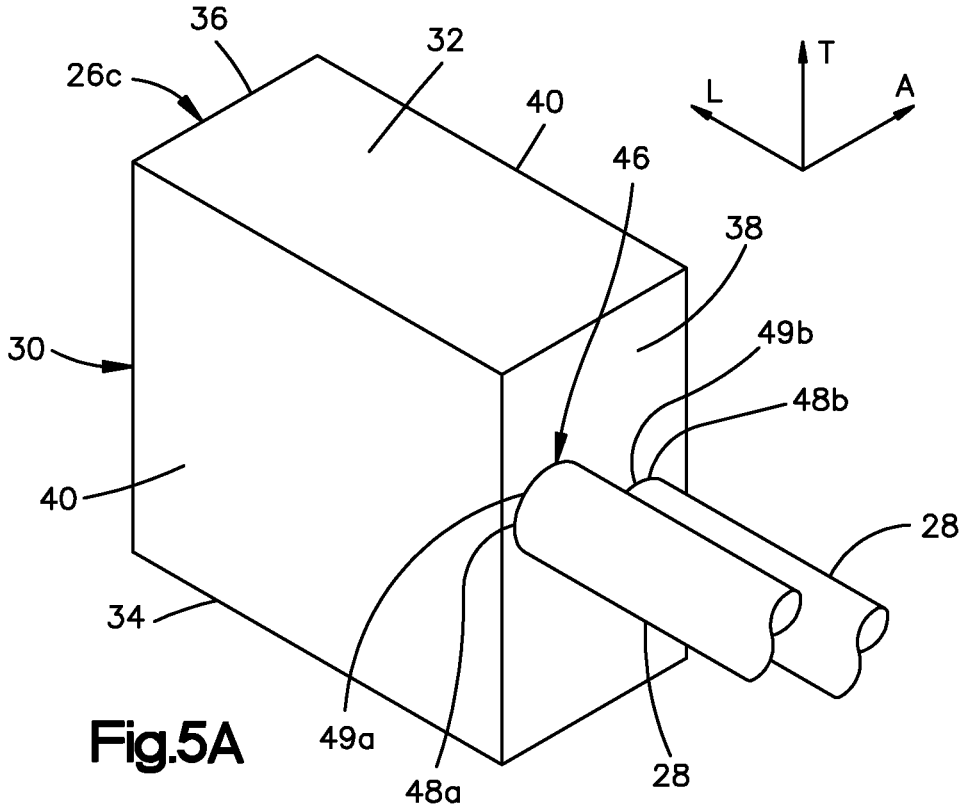
FIG. 5A is a schematic perspective view of another of the cable connector assemblies exploded out in FIG. 1, shown similar to the cable connector assembly illustrated in FIGS. 2A-D, but wherein the mounting interface of the cable connector supports the pair of cables in a first diagonal spatial relationship.
Figure 5B:
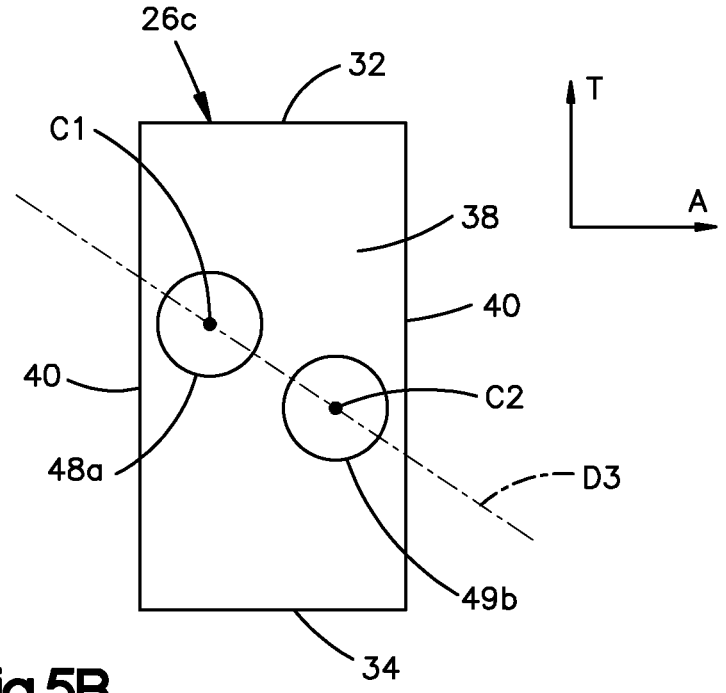
FIG. 5B is a rear elevation view of the cable connector assembly illustrated in FIG. 5A.

Referring now to FIGS. 5A-B, the cable retaining apertures 48*a-b* of the at least one third cable connector 26*c*, for instance the centroids C1 and C2 of the cable retaining apertures 48*a-b*, are spaced apart along a third direction D3 that is defined by a line that passes through the centroids C1 and C2. The third direction D3 is illustrated as a first diagonal direction that is angularly offset with respect to both the lateral direction A and the transverse direction T. Accordingly, the centroids C1 and C2 of the cable retaining apertures 48*a-b*, and thus the corresponding first and second cables 28 that are retained in the cable retaining apertures 48*a-b*, are spaced apart both horizontally and vertically when the at least one third cable connector 26*c* is mounted onto the panel 22 in the manner described above. In accordance with the illustrated embodiment, the centroids C1 and C2 of the cable retaining apertures 48*a-b* are spaced a first distance in the lateral direction A (or horizontally when the cable connector 26*c* is mounted onto the panel 22) and a second distance in the transverse direction T (or vertically when the cable connector 26*c* is mounted onto the panel 22), such that the first distance is greater than the second distance, though it should be appreciated that the second distance can be greater than the first distance, and further that the second distance can be substantially equal to the first distance, as desired. When the at least third cable connector 26*c* is mounted onto the panel 22, it should be appreciated that the respective cables 28 can be bent and routed along a desired cable route path that is angularly offset with respect to the direction in which the cable retaining apertures 48*a-b* are spaced, such that the cables 28 do not interfere with each other and further do not substantially interfere with cables of other cable connectors of the cable connector system 20. Accordingly, the cable retaining apertures 48*a-b* are spaced apart along a direction that has a directional component angularly offset with respect to the desired cable route path. For instance, the cable retaining apertures 48*a-b* are spaced apart along a direction that is substantially perpendicular to the cable route path of the cables 28 that are attached to the at least one third cable connector 26*c*.

Accordingly, in the embodiment illustrated in FIGS. 5A-B, the cable route path can be substantially diagonal, such that the cables 28 can be bent so as to extend along both the lateral and transverse direction A and T as they extend out from the connector housing 30. In accordance with one embodiment, the cable route path can extend a first distance in the lateral direction A and a second distance in the transverse direction T, wherein the second distance is greater than the first distance. Alternatively, the second distance can be less than or substantially equal to the first distance. The cable route paths of the cables 28 can be substantially parallel to each other along substantially the same direction, or the route paths of the cables 28 can be substantially opposite to each other. It should be appreciated that the route paths of the cables 28 can be offset with respect to a pure perpendicular direction with respect to the direction that the centroids C1 and C2 of the cable retaining apertures 48*a-b* are spaced depending, for instance, on the distance or clearance between the adjacent cables 28 of the third cable connector 26*c* and the cables 28 of other cable connectors of the cable connector system 20.

Figure 6A:
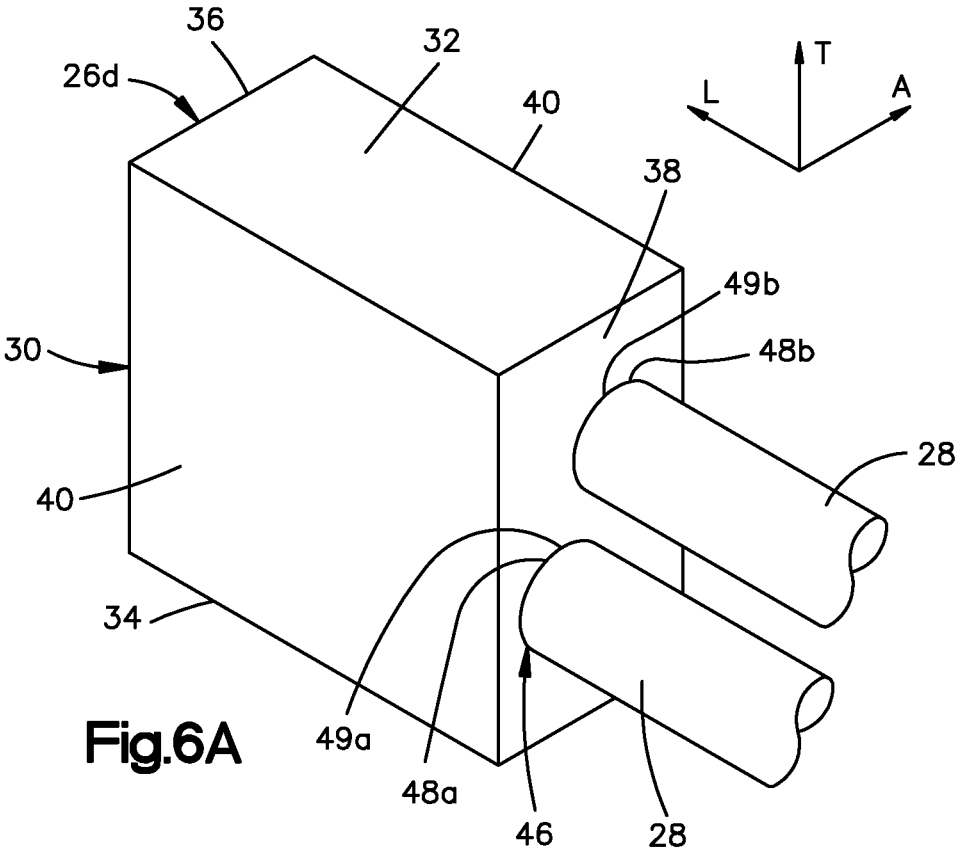
FIG. 6A is a schematic perspective view of another of the cable connector assemblies exploded out in FIG. 1, shown similar to the cable connector assembly illustrated in FIGS. 2A-D, but wherein the mounting interface of the cable connector supports the pair of cables in a second diagonal spatial relationship.
Figure 6B:
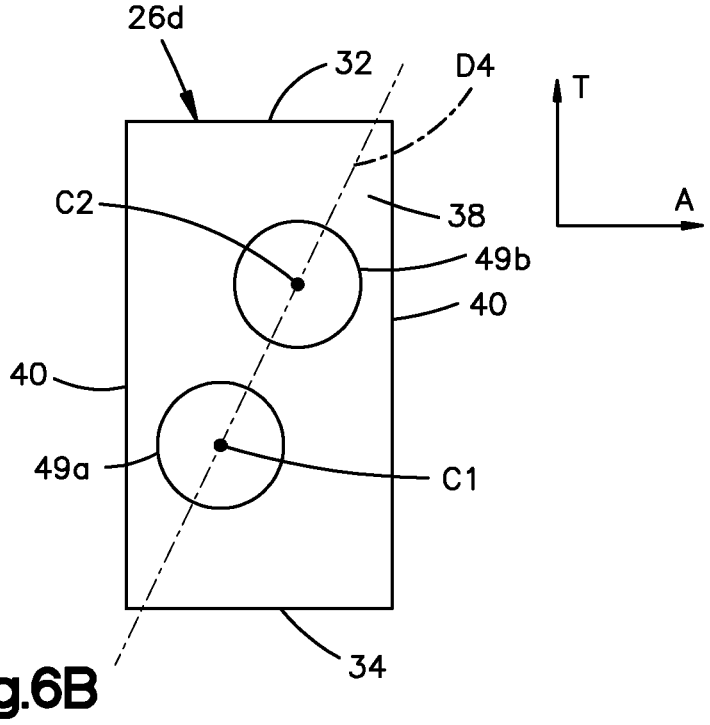
FIG. 6B is a rear elevation view of the cable connector assembly illustrated in FIG. 6A.
Figure 7A:
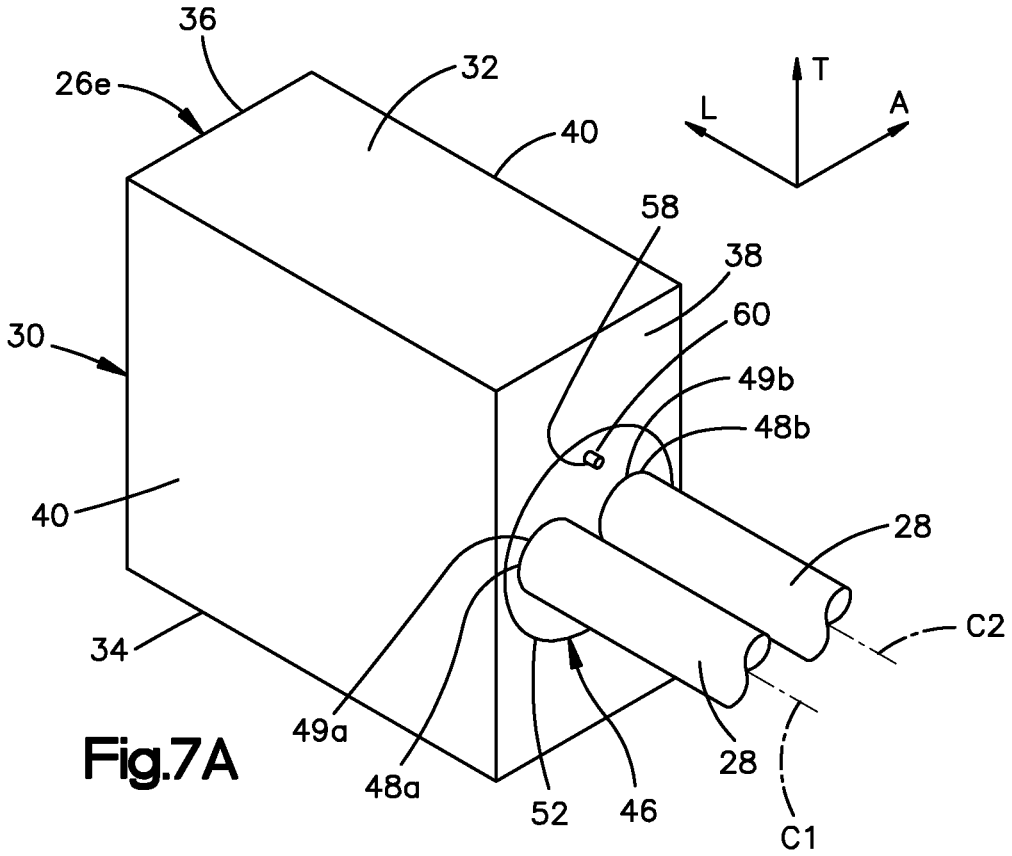
FIG. 7A is a schematic perspective view of another of the cable connector assemblies exploded out in FIG. 1, shown similar to the cable connector assembly illustrated in FIGS. 2A-D, but wherein the mounting interface of the cable connector supports the pair of cables in an adjustable spatial relationship.
Figure 7B:
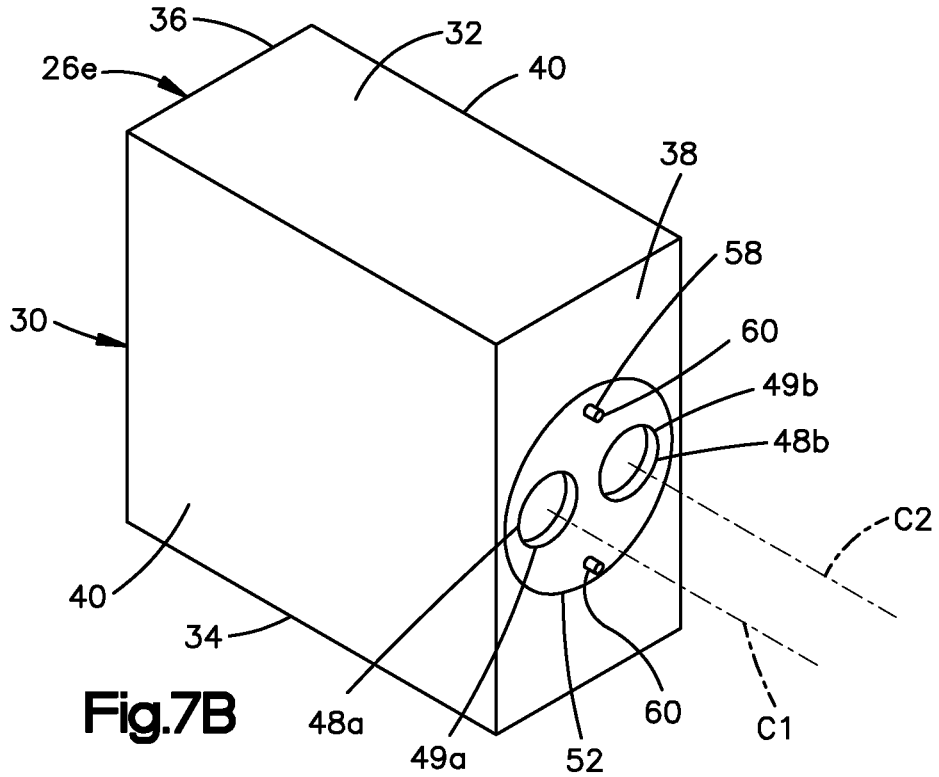
FIG. 7B is a schematic perspective view of the cable connector illustrated in FIG. 7A.
Figure 7C:
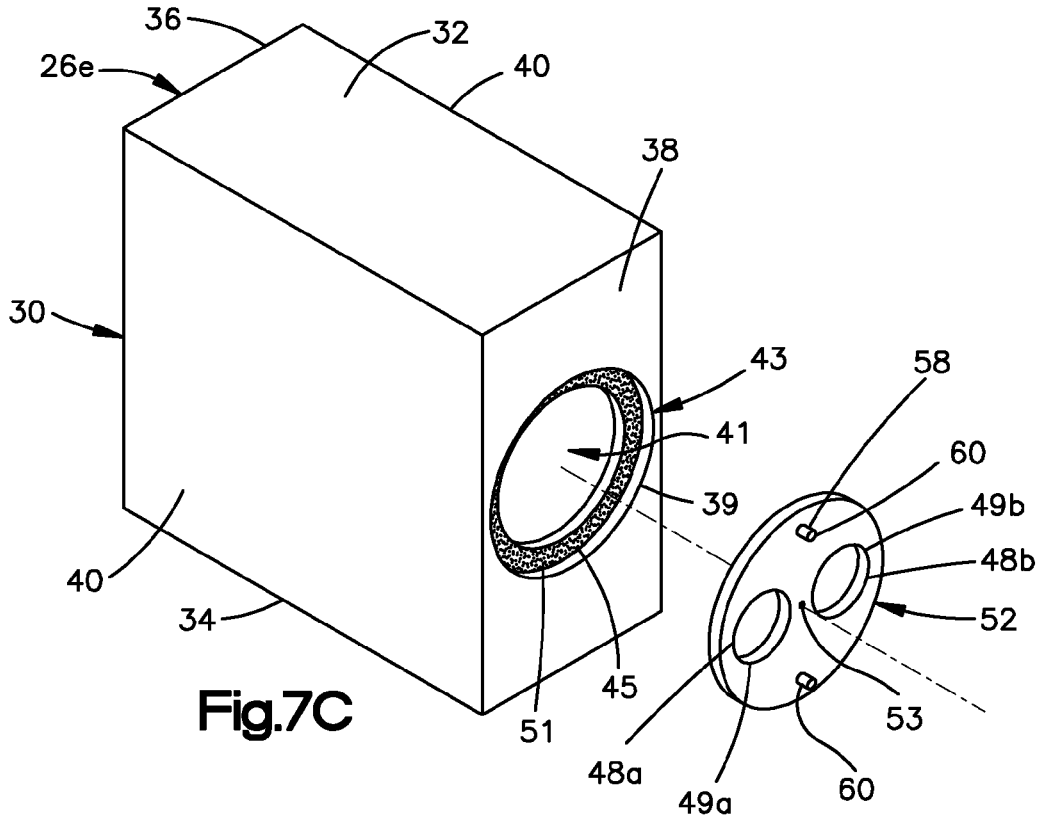
FIG. 7C is an exploded schematic perspective view of the cable connector illustrated in FIG. 7B.
Figure 7E:
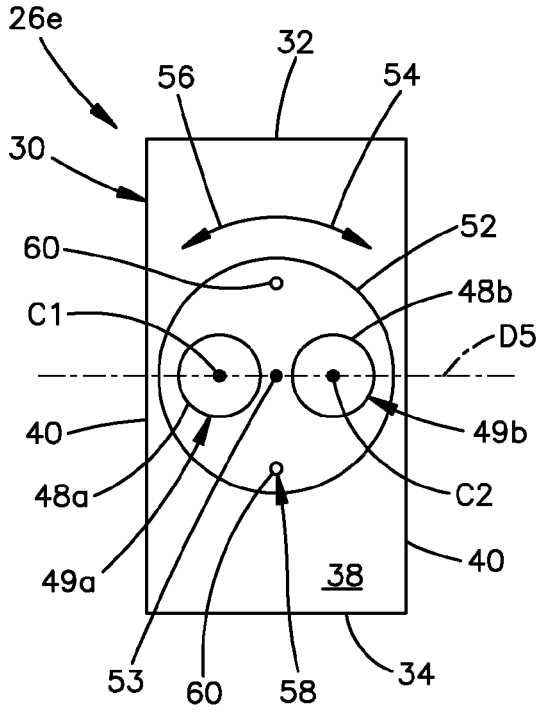
FIG. 7E is a rear elevation view of the cable connector illustrated in FIG. 7B.
Figure 7D:
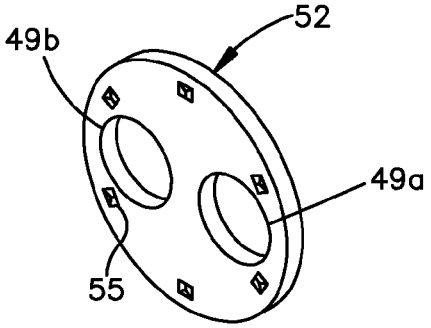
FIG. 7D is a perspective view of a rear face of a rotatable dial of the cable connector illustrated in FIG. 7C.

Referring now to FIGS. 6A-B, the cable retaining apertures 48*a-b* of the at least one fourth cable connector 26*d*, for instance the centroids C1 and C2 of the cable retaining apertures 48*a-b*, are spaced apart along a fourth direction D4 includes a line that passes through the centroids C1 and C2. The fourth direction D4 is illustrated as extending along the transverse direction T. The fourth direction D4 is illustrated as a second diagonal direction that is angularly offset with respect to both the lateral direction A and the transverse direction T, and different than the first diagonal direction. For instance, the second diagonal direction can extend substantially perpendicular to the first diagonal direction. Accordingly, the centroids C1 and C2 of the cable retaining apertures 48*a-b*, and thus the corresponding first and second cables 28 that are retained in the cable retaining apertures 48*a-b*, are spaced apart both horizontally and vertically when the at least one fourth cable connector 26*d* is mounted onto the panel 22 in the manner described above. In accordance with the illustrated embodiment, the centroids C1 and C2 of the cable retaining apertures 48*a-b* are spaced a first distance in the lateral direction A (or horizontally when the cable connector 26*d* is mounted onto the panel 22) and a second distance in the transverse direction T (or vertically when the cable connector 26*d* is mounted onto the panel 22), such that the second distance is greater than the first distance, though it should be appreciated that the second distance can be less than or substantially equal to the first distance as desired. When the at least one fourth cable connector 26*d* is mounted onto the panel 22, it should be appreciated that the respective cables 28 can be bent and routed along a desired cable route path that is angularly offset with respect to the direction in which the cable retaining apertures 48*a-b* are spaced, such that the cables 28 do not interfere with each other and further do not substantially interfere with cables of other cable connectors of the cable connector system 20. Accordingly, the cable retaining apertures 48*a-b* are spaced apart along a direction that has a directional component angularly offset with respect to the desired cable route path. For instance, the cable retaining apertures 48*a-b* are spaced apart along a direction that is substantially perpendicular to the cable route path of the cables 28 that are attached to the at least one fourth cable connector 26*c*.

Accordingly, in the embodiment illustrated in FIGS. 6A-B, the cable route path can be substantially diagonal, such that the cables 28 can be bent so as to extend both along the lateral and transverse direction A and T as they extend out from the connector housing 30. In accordance with one embodiment, the cable route path can extend a first distance in the lateral direction A and a second distance in the transverse direction T, wherein the first distance is greater than the second distance. Alternatively, the first distance can be less than or substantially equal to the second distance. The cable route paths of the cables 28 can be substantially parallel to each other along substantially the same direction, or the route paths of the cables 28 can be substantially opposite to each other. It should be appreciated that the route paths of the cables 28 can be offset with respect to a pure perpendicular direction with respect to the direction that the centroids C1 and C2 of the cable retaining apertures 48*a-b* are spaced depending, for instance, on the distance or clearance between the adjacent cables 28 of the at least one fourth cable connector 26*d* and the cables 28 of other cable connectors of the cable connector system 20

Referring now to FIGS. 7A-E, the cable retaining apertures 48*a-b* of the at least one fifth cable connector 26*e*, for instance the centroids C1 and C2 of the cable retaining apertures 48*a-b*, are spaced apart along a fifth direction D5 that includes a line that passes through the centroids C1 and C2. The fifth direction D5 is angularly adjustable between at least a first position and a second position that is angularly offset with respect to the first direction. In accordance with one embodiment, the first position of the fifth direction D5 can be angularly adjustable to the first direction D1, the second direction D2, the third direction D3, the fourth direction D4, and the second position can be angularly adjustable to the first direction D1, the second direction D2, the third direction D3, and the fourth direction D4. For instance, the rear end 38 of the connector housing 30 of the fifth cable connector 26*e* can include a dial 52 that is movable or rotatable with respect to at least a portion of the connector housing 30, such as the sides 40, the top end 32, and the bottom end 34, and is thus rotatable with respect to the panel 22 when the at least one fifth cable connector 26*e* is mounted onto the panel 22.

The at least one fifth cable connector 26*e* can include first and second cable retaining apertures 48*a-b* that extend through the dial 52 along the longitudinal direction L, such that at least a portion of the cables 28 extends through the respective first and second cable retaining apertures 48*a-b* and is electrically connected to the electrical contacts of the fifth cable connector 26*e*. The dial 52 can, for instance, define a central axis of rotation 53 that extends along the longitudinal direction, such that the dial 52 is rotatable about the central axis of rotation 53 in a plane defined by the lateral direction A and the transverse direction T so as to change the angular orientation of the fifth direction D5 in the manner described above. The rear end 38 of the connector housing 30 can include a recessed region 39 that is sized to receive the dial 52, and at least one aperture 41 that extends through the recessed region 39 and is aligned with the first and second cable retaining apertures 48*a-b* of the dial 52 when the dial is received in the recessed region. Thus, the cables 28 are configured to extend through the cable retaining apertures 48*a-b*, through the at least one aperture 41, and connect to the electrical contacts of the at least one fifth electrical connector 26*e* in the manner described above.

In accordance with the illustrated embodiment the cable retaining apertures 48*a-b*, and thus the cables 28, can be rotated along either or both of first and opposed second rotatable directions 54 and 56, which can be clockwise and counterclockwise respectively. Accordingly, the dial 52 can be rotated to a select cable management orientation such that the cable retaining apertures 48*a-b* are aligned in a select one of the first direction D1, the second direction D2, the third direction D3, the fourth direction D4, or any other direction angularly offset with respect to the first direction D1, the second direction D2, the third direction D3, and the fourth direction D4. Thus, movement of the dial 52 can change an intersection angle defined by the fifth direction D5 and a first reference plane, which can be a horizontal plane, for instance as defined by the top or bottom end of the connector housing 30.

In accordance with one embodiment, the dial 52 can include an engagement member 58 that is configured to mate with a complementary engagement member of a tool such that the tool can apply a torsional force to the dial about the central axis of rotation 53, for instance when a rotational force is applied to the tool. In accordance with the illustrated embodiment, the engagement member 58 can define at least one projection 60 such as a pair of projections 60 that are configured to be received in complementary recesses of the tool. Alternatively, the engagement member 58 of the dial 52 can define a pair of opposed recesses that are configured to be receive in complementary projections of the tool. Alternatively still, at least a portion of the dial 52 projects longitudinally outward so as to define an exposed radially outer surface that can be gripped so as to rotate the dial 52 about the axis of rotation 53.

The at least one fifth electrical connectors 26*e* can further include a stopping mechanism 43 that is configured to retain, for instance releasably retain, the dial 52 in a select orientation. For instance, the stopping mechanism 43 can include a ratchet assembly 45 coupled between the dial 52 and a portion of the rear end 38 of the connector housing 30. The ratchet assembly 45 can include a first set of at least one tooth 51 such as a plurality of outwardly projecting teeth 51 carried by the rear end 38 of the connector housing 30, and a second set of at least one tooth 55 such as a plurality of teeth 55 that extend longitudinally out from the dial 52. At least one of the sets of teeth 51 and 55 are configured to deflect as they ride along the other set of teeth, such that the teeth 51 and 55 can interlock as the dial 52 rotates to a select angular orientation. The teeth 51 and 55 can be configured to allow for only unidirectional rotation of the dial 52 if desired. Alternatively or additionally, the dial 52 can include an aperture configured to receive a set screw that can be driven against the rear end 38 of the connector housing 30 so as to releasably lock the dial 52 in the select orientation.

Referring again to FIG. 1, it should thus be appreciated that the cable connector system 20 can include at least a pair of cable connectors including 1) a first cable connector selected from the group comprising the at least one first cable connector 26*a*, the at least one second cable connector 26*b*, the at least one third cable connector 26*c*, the at least one fourth cable connector 26*d*, and the at least one fifth cable connector 26*e*, and 2) a second cable connector that is selected from a different one, with respect to the first cable connector, of the group comprising the at least one first cable connector 26*a*, the at least one second cable connector 26*b*, the at least one third cable connector 26*c*, the at least one fourth cable connector 26*d*, and the at one least fifth cable connector 26*e*. The cable connector system 20 can include as many cable connectors as desired selected from the group comprising the at least one first cable connector 26*a*, the at least one second cable connector 26*b*, the at least one third cable connector 26*c*, the at least one fourth cable connector 26*d*, the at least one fifth cable connector 26*e*, and any suitable alternatively constructed cable connector as desired.

Thus, the cable connector system 20 can include a first cable connector that defines a mating end configured to mate with a complementary electrical component, and a mounting end that defines first and second cable retaining apertures that are each configured to retain a respective one of a pair of cables electrically connected to the first cable connector, wherein the first and second cable retaining apertures are spaced in a first direction. The cable connector system 20 can further include a second cable connector that defines a mating end configured to mate with a complementary electrical component, and a mounting end that defines first and second cable retaining apertures that are each configured to retain a respective one of a pair of cables electrically connected to the second cable connector, wherein the first and second cable retaining apertures of the second cable connector are spaced in a second direction that is angularly offset with respect to the first direction. For instance, the second direction can be substantially perpendicular to the first direction.

With continuing reference to FIG. 1, a cable connector kit can include a first cable connector configured to be mounted onto a panel. The first cable connector defines a first mating end configured to mate with a complementary electrical component when the first cable connector is mounted onto the panel, and a mounting end that defines first and second cable retaining apertures that are each configured to retain a respective one of a pair of cables electrically connected to the first cable connector. The first and second cable retaining apertures are spaced in a first direction. The kit can include a second cable connector configured to be mounted onto the panel, the second cable connector defining a second mating end constructed identically with respect to the first mating end and configured to mate with the complementary electrical component when the second cable connector is mounted onto the panel. The second cable connector can further define a mounting end that defines first and second cable retaining apertures that are each configured to retain a respective one of a pair of cables electrically connected to the second cable connector. The first and second cable retaining apertures of the second cable connector are spaced in a second direction that is angularly offset with respect to the first direction, the first and second directions defined by orientations in which the respective first and second cable connectors are to be mounted onto the panel. For instance, the second direction can be substantially perpendicular to the first direction.

The kit can further include a third cable connector configured to be mounted onto the panel, the third cable connector defining a third mating end constructed identically with respect to the first and second mating ends and configured to mate with the complementary electrical component when the third cable connector is mounted onto the panel. The third cable connector can further define a mounting end that defines first and second cable retaining apertures that are each configured to retain a respective one of a pair of cables electrically connected to the third cable connector. The first and second cable retaining apertures of the third cable connector are spaced in a third direction that is angularly offset with respect to the first and second directions, the third direction defined by an orientation in which the third cable connector is to be mounted onto the panel.

The kit can further define a fourth cable connector configured to be mounted onto the panel, the fourth cable connector defining a fourth mating end constructed identically with respect to the first, second, and third mating ends and configured to mate with the complementary electrical component when the fourth cable connector is mounted onto the panel. The fourth cable connector can further define a mounting end that defines first and second cable retaining apertures that are each configured to retain a respective one of a pair of cables electrically connected to the fourth cable connector. The first and second cable retaining apertures of the fourth cable connector are spaced in a fourth direction that is angularly offset with respect to the first, second, and third directions, the fourth direction defined by an orientation in which the fourth cable connector is to be mounted onto the panel.

The kit can further include a fifth cable connector configured to be mounted onto the panel, the fifth cable connector defining a fifth mating end constructed identically with respect to the first, second, and third, and fourth mating ends and configured to mate with the complementary electrical component when the fifth cable connector is mounted onto the panel. The fifth cable connector can further define a mounting end that defines first and second cable retaining apertures that are each configured to retain a respective one of a pair of cables electrically connected to the fifth cable connector. The first and second cable retaining apertures of the fifth cable connector are spaced in a fifth direction that adjustable so as to be angularly offset with respect to the first, second, third, and fourth directions, the fifth direction defined by an orientation in which the fifth cable connector is to be mounted onto the panel. It should be appreciated that the first and second cable retaining apertures of any of the first, second, third, fourth, and fifth cable connectors of the kit can define an adjustable orientation as described above with respect to FIGS. 7A-B.

With continuing reference to FIG. 1, a method can be provided for mounting a plurality (for instance at least two) of cable connectors 26 onto a panel 22, for instance onto the first panel face 22*a* of the panel 22, that defines a plurality of target mounting locations 64. At least one, such as each, of the plurality of cable connectors 26 can define at least a pair, of cable retaining apertures 48*a-b*. The cable retaining apertures 481*a-b* of the pair of cable retaining apertures 481*a-b* of at least two of the plurality of cable connectors 26 can be spaced apart in different directions. In accordance with one embodiment, the cable retention apertures 48*a-b* of the pair of cable retention apertures 48*a-b* of at least one of the plurality of cable connectors 26 can have an adjustable angular position. In one example, the cable retaining apertures 48*a-b* of the first plurality of cable connectors 26*a* can be spaced apart in the first direction D1, the cable retaining apertures 48*a-b* of the second plurality of cable connectors 26*b* can be spaced apart in the second direction D2, the cable retaining apertures 48*a-b* of the third plurality of cable connectors 26*c* can be spaced apart in the third direction D3, the cable retaining apertures 48*a-b* of the fourth plurality of cable connectors 26*d* can be spaced apart in the fourth direction D4, and the cable retaining apertures 48*a-b* of the fifth plurality of cable connectors 26*e* can be spaced apart in the adjustable direction D5.

The method can include the step of identifying a desired cable route path of the cables 28 that are either attached to the cable connector 26 that is to be mounted at a select target mounting location 64 of the plurality of target mounting locations on the panel 22, or is to be attached to the cable connector 26 that is to be mounted at the select target mounting location 64 of the plurality of target mounting locations on the panel 22. After the identifying step, the method can further include the step of identifying a select cable connector, which can be a first select cable connector, among a plurality of cable connectors 26*a-e*, the first select cable connector defining at least a pair of cable retaining apertures 48*a-b* that are spaced apart along a direction that has a directional component angularly offset with respect to the desired cable route path. After the second identifying step, the method can further include the step of mounting the first select cable connector onto the panel 22 at the select target mounting location 64. After the mounting step, the method can further include the step of routing respective cables 28 that extend out from the cable retaining apertures 48*a-b* of the first select cable connector according to the desired cable route path, for instance along substantially parallel directions that are angularly offset with respect to the direction that the cable retaining apertures 48*a-b* of the first select cable connector are spaced. The method can further comprise the step of routing respective cables that extend out from the cable retaining apertures along different directions, such as opposite directions.

It should be appreciated in accordance with one embodiment that the plurality of cable connectors 26 to be mounted can include at least two of the plurality of cable connectors 26 that each defines at least a respective pair of cable retaining apertures 48*a-b* that are spaced apart in different directions from each other. The cable retaining apertures 48*a-b* of each of the cable connectors 26 are configured to retain a cable that is electrically connected to the two of the plurality of cable connectors, respectively.

The method can further include the step of identifying a second select cable connector among a different one of the plurality of cable connectors 26*a-e* with respect to the first select cable connector, such that the second select cable connector defines at least a pair of cable retaining apertures 48*a-b* that are spaced apart along a direction that has a directional component angularly offset with respect to the desired cable route path of the second select cable connector, and angularly offset with respect to the direction along which the cable retaining apertures 48*a-b* of the first select cable connector are spaced. The method can further include the step of mounting the second select cable connector onto the panel 22 at a respective select target mounting location 64 spaced from the first select cable connector. The method can further include the step of routing respective cables 28 that extend out from the cable retaining apertures 48*a-b* of the second select cable connector along substantially parallel directions. The method can further comprise the step of routing respective cables that extend out from the cable retaining apertures along different directions, such as opposite directions.

A method can be further provided to facilitate mounting a cable connector onto a panel at a target mounting location. The method can include the step of disclosing to a third party, by audible words or a visual depiction fixed in a tangible medium of expression, a plurality of cable connectors 26 including the at least first select cable connector having at least a pair of cable retaining apertures 48*a-b* spaced along a first direction and the second select cable connector having at least a pair of cable receiving apertures 48*a-b* spaced along a second direction, as described above. The method can further include the step of transferring the first and second select cable connectors to the third party, a contract manufacturer of the third party, or an agent of the third party. The method can further include the step of disclosing to the third party, by an act of providing audible words or a visual depiction fixed in a tangible medium of expression, that cables extending from the cable retaining apertures of a select one of the first and second cable connectors has a reduced bend radius with respect to cables extending from the cable retaining apertures of the other of the first and second cable connectors when the select one of the first and second cable connectors is mounted onto the panel at the target mounting location compared to when the other of the first and second cable connector is mounted onto the panel at the target mounting location.

A method to facilitate mounting a cable connector onto a panel at a target mounting location can also include the step of disclosing to a third party, by audible words or a visual depiction fixed in a tangible medium of expression, a plurality of cable connectors including at least a first cable connector having at least a pair of cable retaining apertures spaced along a first direction. The method can further include performing the steps of inquiring and/or transferring (thus at least one of the steps of inquiring and transferring). The inquiring step includes delivering an inquiry, by an act of providing audible words or a visual depiction fixed in a tangible medium of expression regarding an identity of a desired cable route path to the third party, a contract manufacturer of the third party, or an agent of the third party. The transferring step includes communicating the first direction to the third party, a contract manufacturer of the third party, or an agent of the third party. The method can further include the step of, after the performing step, disclosing to the third party, by an act of providing audible words or a visual depiction fixed in a tangible medium of expression, a cable termination pattern of the at least one cable connector such that cables extending from the cable retaining apertures define a bend radius along the desired cable route path that is reduced with respect to cables extending from the cable retaining apertures of another cable connector having a pair of cable retaining apertures that are spaced along a direction that is different than the first direction.

Figure 8:
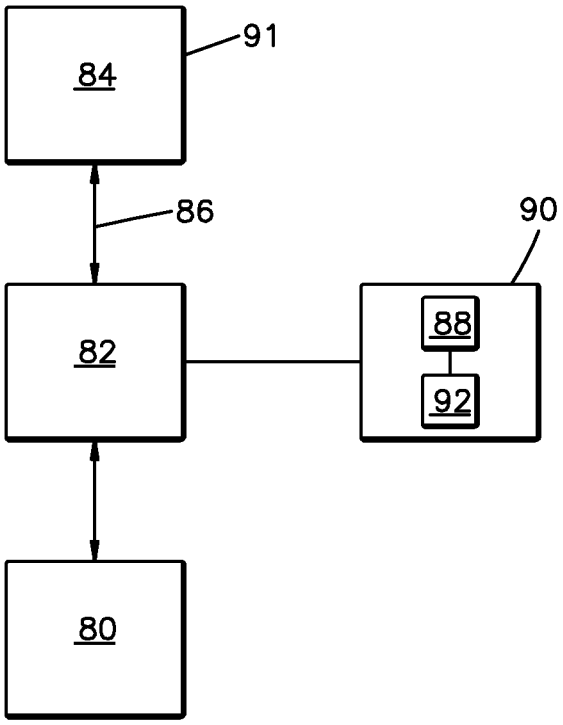
FIG. 8 is a schematic illustration of a network configured to facilitate selection of a cable connector in accordance with one embodiment.

Referring now to FIG. 8, a method can be further provided to identify at least one select cable connector among a plurality of available cable connectors. For instance a host 80, which can belong to a provider of cable connectors, can establish an website 81 over the internet 82 that is accessible by user 84, who can be a customer designing a such as the panel 22 illustrated in FIG. 1. The website 81 can prompt the user 84 to enter information 86 specific to a design architecture of the panel 22. For instance, the website 81 can prompt the user to input the number and location of target mounting locations 64 and associated route paths of cables electrically connected to cable connectors to be mounted to the respective target mounting locations 64, and whether the type of the cable connector is a power connector, fiber optic connector, or the like, and the configuration of the connector (e.g., vertical or right-angle). The processor 88 of a server 90 associated with the website 81 can access stored memory 92 to identify the type and configuration of the at least one select cable connector, based on the user input. The website 81 can further prompt the user 84 to input a desired cable route path for each cable that extends out from the at least one select cable connector, the cable route path including a direction that the cables are to extend from the connector housing of the select at least one cable connector (e.g., whether the cables are to be routed right, left, up, down, diagonally, variably, and the like). Based on the input from the user, the processor 88 of the server 90 associated with the website 81 can determine a select one of the cable connectors 26*a-e* is best suited to be mounted to the various target mounting locations 64 of the panel 22, identify the determined select cable connector to the user, and communicate to the host 80 over the internet 82 so as to facilitate the purchase and shipment of the select cable connector to the user. In accordance with one embodiment, the user 84 can enter the information identified above to identify a select cable connector to be mounted to each of the target mounting locations 64 of the panel 22, and the processor 88 of the server 90 associated with the website 81 can identify a plurality of select cable connectors 26*a-e* suitable to be mounted onto the panel 22 in a manner consistent with the user input.

A method can be further provided of selling a cable connector to be mounted onto a panel, such as the panel 22. The method can include the steps of 1) offering, for instance for sale, a cable connector that has a mounting interface that is configured to electrically connect a cable with an electrical contact of the electrical connector, and 2) offering, for instance for sale, at least one electrical connector cable termination pattern, for instance at least two different electrical connector cable terminations patterns at the mounting interface of the electrical connector, based upon a requested cable route path of cables that are to be attached and electrically connected to the cable connector. The requested cable route path can include information regarding the route path itself, and can alternatively or additionally include information regarding a desired cable termination pattern, which can include a direction along which the cable retaining apertures 48*a-b* of the at least one cable connector 26 are spaced.

For instance, the route path can be angularly offset (such as substantially perpendicular) to the cable termination pattern. A first one of the two different electrical connector cable termination patterns can be defined by the mounting interface 46, and in particular the direction that the cable retaining apertures 48*a-b*, of any one of the first at least one cable connector 26*a*, the second at least one cable connector 26*b*, the third at least one cable connector 26*c*, the fourth at least one cable connector 26*d*, and the fifth at least one cable connector 26*e*, are spaced. A second one of the two different electrical connector cable termination patterns can be defined by the mounting interface 46, and in particular the direction that cable retaining apertures 48*a-b*, of any one of the first at least one cable connector 26*a*, the second at least one cable connector 26*b*, the third at least one cable connector 26*c*, the fourth at least one cable connector 26*d*, and the fifth at least one cable connector 26*e*, are spaced. The third party can select the cable connector according to a pre-defined cable route path that corresponds to the electrical connector cable termination pattern.

A method can further be provided for mounting a plurality of cable connectors to a panel that defines a plurality of target mounting locations. The method can include the step of identifying or teaching a desired cable route path associated with a select target mounting location of the plurality of target mounting locations. The method can further include the step of teaching the step of identifying a select cable connector among a plurality of cable connectors after the identifying or teaching step, the select cable connector defining at least a pair of cable retaining apertures that are spaced apart along a direction that has a directional component angularly offset with respect to the desired cable route path. The method can further include, after the step of teaching the step of identifying, teaching the step of mounting the select cable connector onto the panel at the select target mounting location. The method can further include, after the step of teaching the step of mounting, teaching the step of routing the cables according to the desired cable route path.

The embodiments described in connection with the illustrated embodiments have been presented by way of illustration, and the present invention is therefore not intended to be limited to the disclosed embodiments. Furthermore, the structure and features of each the embodiments described above can be applied to the other embodiments described herein, unless otherwise indicated. For instance, the pair of spaced cable retaining apertures 48*a-b* can alternatively be defined by a pair of cable connectors 26, such that a first cable retaining aperture 48 of the pair of cable retaining apertures 48 is defined by a first cable connector 26, and a second cable retaining aperture 48 of the pair of cable retaining apertures 48*a-b* is defined by a second cable connector 26 that is disposed immediately adjacent the first cable connector 26 when the first and second cable connectors 26 are mounted on the panel 22. Accordingly, those skilled in the art will realize that the invention is intended to encompass all modifications and alternative arrangements included within the spirit and scope of the invention, for instance as set forth by the appended claims.

What is claimed:

1. A cable connector kit comprising:

a first cable connector configured to be mounted onto a panel, the first cable connector defining a first mating end configured to mate with a complementary electrical component when the first cable connector is mounted onto the panel, the first mating end including a first upper end surface and a first lower end surface spaced from the upper end surface along a transverse direction, and the first cable connector further defining a first mounting end spaced from the first mating end along a longitudinal direction, perpendicular to the transverse direction, the first mounting end defining first and second cable retaining apertures that are each configured to retain a respective one of a pair of cables electrically connected to the first cable connector, the first and second cable retaining apertures being spaced from one another in a first direction that extends along a plane that is perpendicular to the longitudinal direction; and a second cable connector configured to be mounted onto the panel, the second cable connector defining a second mating end constructed identically with respect to the first mating end and configured to mate with the complementary electrical component when the second cable connector is mounted onto the panel, the second mating end including a second upper end surface that is identical to the first upper end surface and a second lower end surface that is identical to the first lower end surface, the second cable connector further defining a second mounting end that is spaced from the second mating end along the longitudinal direction and that defines first and second cable retaining apertures that are each configured to retain a respective one of a pair of cables electrically connected to the second cable connector, the first and second cable retaining apertures of the second cable connector being spaced from one another in a second direction, wherein when the second upper end surface is spaced from the second lower end surface along the transverse direction, the second direction is angularly offset with respect to the first direction and extends along a plane that is perpendicular to the longitudinal direction.

2. The cable connector kit as recited in claim 1, wherein the second direction is substantially perpendicular to the first direction.

3. The cable connector kit as recited in claim 1, further comprising a third cable connector configured to be mounted onto the panel, the third cable connector defining a third mating end constructed identically with respect to the first and second mating ends and configured to mate with the complementary electrical component when the third cable connector is mounted onto the panel, the third cable connector further defining a mounting end that defines first and second cable retaining apertures that are each configured to retain a respective one of a pair of cables electrically connected to the second cable connector, wherein the first and second cable retaining apertures of the third cable connector are spaced in a third direction that is angularly offset with respect to the first and second directions.

4. The cable connector kit as recited in claim 1, wherein the first and second cable retaining apertures of the first cable connector defines an adjustable orientation, such that the first direction is adjustable relative to the first cable connector.

5. The cable connector kit as recited in claim 4, wherein the first cable connector comprises a dielectric housing, and a rotatable dial that is mounted to the dielectric housing and the first cable connector defines the first and second cable retaining apertures, such that rotation of the dial with respect to the dielectric housing changes the first direction.

6. The cable connector kit as recited in claim 1, wherein each of the first and second cable retaining apertures of the first cable connector define a respective centroid, such that the centroids are spaced apart from each other along the first direction, and the first direction has a directional component angularly offset with respect to a desired cable route path of the cables that are electrically connected to the first cable connector.

7. The cable connector kit as recited in claim 6, wherein the first direction is substantially perpendicular with respect to the desired route path.

8. The cable connector kit as recited in claim 6, wherein each of the first and second cable retaining apertures of the second cable connector define a respective centroid, such that the centroids of the second cable connector are spaced apart from each other along the second direction, and the second direction has a directional component angularly offset with respect to a desired cable route path of the cables that are electrically connected to the second cable connector.

9. The cable connector kit as recited in claim 8, wherein the second direction is substantially perpendicular with respect to the desired cable route path of the cables that are electrically connected to the second cable connector.

10. The cable connector kit as recited in claim 1, wherein the first direction is a vertical direction when the first cable connector is mounted onto the panel.

11. The cable connector kit as recited in claim 1, wherein the first direction is a diagonal direction when the first cable connector is mounted onto the panel.

12. The cable connector kit as recited in claim 11, wherein the diagonal direction is closer to a horizontal direction than a vertical direction when the first cable connector is mounted onto the panel.

13. The cable connector kit as recited in claim 11, wherein the diagonal direction is closer to a vertical direction than a horizontal direction when the first cable connector is mounted onto the panel.

14. The cable connector kit as recited in claim 1, further comprising the cables mounted to the first and second cable connectors through the respective first and second cable retaining apertures.

15. The cable connector kit of claim 1, wherein:

the first mating end includes at least one first electrical contact, and at least one second electrical contact spaced from the at least one first electrical contact along the transverse direction; and the second mating end includes at least one third electrical contact, and at least one fourth electrical contact spaced from the at least one third electrical contact along the transverse direction.

16. A cable connector kit comprising:

a first cable connector configured to be mounted onto a panel, the first cable connector defining a first mating end configured to mate with a complementary electrical component when the first cable connector is mounted onto the panel, the first mating end including at least one first electrical contact, and at least one second electrical contact spaced from the at least one first electrical contact along a transverse direction, and the first cable connector further defining a first mounting end spaced from the first mating end along a longitudinal direction, perpendicular to the transverse direction, the first mounting end defining first and second cable retaining apertures that are each configured to retain a respective one of a pair of cables electrically connected to the first cable connector, the first and second cable retaining apertures being spaced from one another in a first direction that extends along a plane that is perpendicular to the longitudinal direction; and a second cable connector configured to be mounted onto the panel, the second cable connector defining a second mating end configured to mate with the complementary electrical component when the second cable connector is mounted onto the panel, the second mating end including at least one third electrical contact, and at least one fourth electrical contact spaced from the at least one third electrical contact, the second cable connector further defining a second mounting end that is spaced from the second mating end along the longitudinal direction and that defines first and second cable retaining apertures that are each configured to retain a respective one of a pair of cables electrically connected to the second cable connector, the first and second cable retaining apertures of the second cable connector being spaced from one another in a second direction, wherein when the at least one fourth electrical contact is spaced from the at least one third electrical contact along the transverse direction, the second direction is angularly offset with respect to the first direction and extends along a plane that is perpendicular to the longitudinal direction.

17. The cable connector kit of claim 16, wherein the first mating end includes a first substrate that carries the at least first electrical contact and the second mating end includes a second substrate that carries the at least second electrical contact and that is spaced from the first substrate along the transverse direction.

18. the cable connector kit of claim 17, wherein each of the at least first and second electrical contacts extends along the longitudinal direction and a lateral direction that is perpendicular to both the longitudinal and transverse directions.

19. The cable connector kit of claim 16, wherein:

the first mating end of the first cable connector includes a first upper end surface, and a first lower end surface spaced from the upper end surface along the transverse direction;

the second mating end includes a second upper end surface that is identical to the first upper end surface, and a second lower end surface that is identical to the first lower end surface and that is spaced from the second upper end surface along the transverse direction; and the first and second directions extend along first and second planes, respectively, that are perpendicular to the longitudinal direction.

20. A cable connector kit comprising:

a first cable connector configured to be mounted onto a panel, the first cable connector defining a first mating end configured to mate with a complementary electrical component when the first cable connector is mounted onto the panel, and a mounting end that defines first and second cable retaining apertures that are each configured to retain a respective one of a pair of cables electrically connected to the first cable connector, wherein the first and second cable retaining apertures are spaced in a first direction;

a second cable connector configured to be mounted onto the panel, the second cable connector defining a second mating end constructed identically with respect to the first mating end and configured to mate with the complementary electrical component when the second cable connector is mounted onto the panel, the second cable connector further defining a mounting end that defines first and second cable retaining apertures that are each configured to retain a respective one of a pair of cables electrically connected to the second cable connector, wherein the first and second cable retaining apertures of the second cable connector are spaced in a second direction that is angularly offset with respect to the first direction, wherein the first and second cable retaining apertures of the first cable connectors define an adjustable orientation such that the first direction is adjustable, the first cable connector comprises a dielectric housing, a rotatable dial is mounted to the dielectric housing, and the first cable connector defines the first and second cable retaining apertures such that rotation of the dial with respect to the dielectric housing changes the first direction.

21. The cable connector kit of claim 20, wherein the rotatable dial is configured to be rotated so as to route the respective cables along a desired cable route path.

22. The cable connector kit of claim 20, wherein each of the first and second cable retaining apertures of the first cable connector define a respective centroid, such that the respective centroids are spaced apart from each other along the first direction.

23. The cable connector kit of claim 20, wherein:

the first and second mating ends are spaced from the mounting ends of the first and second cable connectors, respectively, along a longitudinal direction;

the first mating end of the first cable connector includes a first upper end surface, and a first lower end surface spaced from the upper end surface along a transverse direction, perpendicular to the longitudinal direction;

the second mating end includes a second upper end surface that is identical to the first upper end surface, and a second lower end surface that is identical to the first lower end surface and that is spaced from the second upper end surface along the transverse direction; and the first and second directions extend along first and second planes, respectively, that are perpendicular to the longitudinal direction.

24. The cable connector kit of claim 20, wherein:

the first and second mating ends are spaced from the mounting ends of the first and second cable connectors, respectively, along a longitudinal direction;

the first mating end includes at least one first electrical contact, and at least one second electrical contact spaced from the at least one first electrical contact along a transverse direction, perpendicular to the longitudinal direction; and the second mating end includes at least one third electrical contact, and at least one fourth electrical contact spaced from the at least one third electrical contact along the transverse direction.

* * * * *